US007269362B2

(12) United States Patent
Hama et al.

(10) Patent No.: US 7,269,362 B2
(45) Date of Patent: Sep. 11, 2007

(54) IMAGE FORMING APPARATUS, CONTROL METHOD AND TONER CONSUMPTION CALCULATING APPARATUS AND METHOD

(75) Inventors: Takashi Hama, Nagano-ken (JP); Hidetsugu Shimura, Nagano-ken (JP); Hidenori Kin, Nagano-ken (JP); Keiichi Taguchi, Nagano-ken (JP); Hiroshi Nakazato, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 559 days.

(21) Appl. No.: 10/855,981

(22) Filed: May 27, 2004

(65) Prior Publication Data

US 2005/0185973 A1 Aug. 25, 2005

(30) Foreign Application Priority Data

May 29, 2003 (JP) ..... 2003-151930
May 30, 2003 (JP) ..... 2003-155572
May 30, 2003 (JP) ..... 2003-155573
Mar. 26, 2004 (JP) ..... 2004-090966

(51) Int. Cl.
*G03G 15/08* (2006.01)

(52) U.S. Cl. ..... 399/27; 399/49; 399/60

(58) Field of Classification Search ..... 399/9, 399/24, 27, 29, 30, 49, 222, 227, 302, 308, 399/58, 60
See application file for complete search history.

(56) References Cited

U.S. PATENT DOCUMENTS 5,812,903 A * 9/1998 Yamada et al. ..... 399/42
6,341,203 B1 1/2002 Nakazato et al.
6,415,114 B1 7/2002 Nakazato et al.
6,597,878 B2 7/2003 Nakazato et al.
7,013,093 B2 * 3/2006 Nakazato ..... 399/27
7,149,439 B2 * 12/2006 Hirata et al. ..... 399/29
2002/0041770 A1 4/2002 Nakazato et al.

FOREIGN PATENT DOCUMENTS

| | | |
|---|---|---|
| EP | 1 074 891 | 2/2001 |
| EP | 1 193 566 | 4/2002 |
| JP | 06-250480 | 9/1994 |
| JP | 2729976 | 3/1998 |
| JP | 11-265132 | 9/1999 |
| JP | 2001-75319 | 3/2001 |
| JP | 2001-290320 | 10/2001 |
| JP | 2002-116614 | 4/2002 |
| JP | 2002-174929 | 6/2002 |
| JP | 2002-278249 | 9/2002 |

* cited by examiner

*Primary Examiner*—Hoan Tran
(74) *Attorney, Agent, or Firm*—Hogan & Hartson LLP

(57) ABSTRACT

When the remaining toner amount within a developer is relatively large, a control target value of a toner amount is set to Ttgt1, and a lower limit value of a toner amount which can regarded proper is set to TL1. When the density of a patch image formed under a predetermined condition is smaller than a minimum guaranteed density Dma, it is determined abnormality has occurred in the apparatus. Since the characteristic of toner within the developer changes as the remaining toner amount decreases, the control target value is changed to Ttgt2 and the lower limit value is set to TL2 in light of this. In this fashion, regardless of whether the toner characteristic has changed, abnormality in the apparatus is detected without fail.

41 Claims, 27 Drawing Sheets

FIG. 21

| | | REMAINING TONER AMOUNT | |
|---|---|---|---|
| | | 30 g OR MORE | SMALLER THAN 30 g |
| ERROR THRESHOLD | TvH | 0. 99 | 0. 992 |
| | TvL | 0. 9 | 0. 7 |
| | ΔTm | 0. 005 | 0. 003 |
| TARGET CONTROL VALUE | Ttgt | 0. 985 | 0. 98 |

FIRST STATE

SECOND STATE

FIG. 27

| STATE OF ENGINE PART / DENSITY DETECTION RESULT | | FIRST STATE | SECOND STATE |
|---|---|---|---|
| WITHIN APPROPRIATE RANGES | | IMAGE FORMATION UNDER OPTIMAL CONDITION IS POSSIBLE | |
| OUTSIDE APPRO-PRIATE RANGES | EXCESSIVE DENSITY | IMAGE FORMATION IS PROHIBITED | IMAGE FORMATION IS PROHIBITED |
| | INSUFFICIENT DENSITY | | IMAGE FORMATION UNDER OPTIMAL CONDITION OR QUASI-OPTIMAL CONDITION IS POSSIBLE |

IMAGE FORMING APPARATUS, CONTROL METHOD AND TONER CONSUMPTION CALCULATING APPARATUS AND METHOD

CROSS REFERRENCE TO RELATED APPLICATION

The disclosure of Japanese Patent Applications enumerated below including specification, drawings and claims is incorporated herein by reference in its entirely:

No. 2003-151930 filed May 29, 2003;

No. 2003-155572 filed May 30, 2003;

No. 2003-155573 filed May 30, 2003; and

No. 2004-90966 filed Mar. 26, 2004.

BACKGROUND OF THE INVENTION

1. Field of the Invention

The present invention relates to an image forming apparatus which forms an image using toner. The present invention relates in particular to a technique for accurately grasping the states of use of the main section of the apparatus and consumables and for properly managing the apparatus.

2. Description of the Related Art

In the case of an image forming apparatus such as a printer, a copier machine and a facsimile machine which uses toner to form an image, as the apparatus is used more, the quality of an image becomes poorer owing to changes of the state of the apparatus such as a deterioration within the apparatus and a reduction of the remaining toner amount for example. There are various different ideas as for how to grasp such changes of the state of the apparatus and how to deal with these changes.

An example is an apparatus which calculates the amount of remaining toner inside the apparatus based on a count registered in a toner counter which counts the amount of toner which is consumed as an image is formed, and which then determines, from thus calculated remaining toner amount, the timing of exchanging a toner cartridge in which the toner is stored. In other words, when the calculated amount of remaining toner inside the toner cartridge drops beyond a certain level, a display of the image forming apparatus shows a message such as "Please exchange the toner cartridge." to thereby encourage a user to exchange the toner cartridge.

In an effort to make an effective use of resources, users wish to accurately grasp the remaining toner amount and exchange a toner cartridge at a proper time, that is, when toner has been just entirely used. However, conventional toner counting techniques realize only insufficient accurate counting and have thus failed to meet this demand.

Further, among this type of apparatuses are those which form a small test image (patch image) having a predetermined image pattern and adjust their operation conditions based on the result of density detection on the patch image. It is desirable that the result of the density detection on the patch image is utilized to grasp changes of the state of the apparatus. Meanwhile, for an effective use of resources mentioned above, there is a users' demand to form images even at the expense of a deteriorated image quality to an extent tolerable. When an image is to be formed in such a situation, the result of the density detection on the patch image must be specially handled. The conventional control techniques for image forming apparatuses nonetheless have not considered such a need very much.

SUMMARY OF THE INVENTION

The present invention aims at providing an image forming apparatus which solves the problem described above and is hence convenient to users. To be more specific, a first object of the present invention is to provide a toner consumption calculating technique which is configured so as to be capable of exchanging a toner cartridge even when a count registered in a counter is erroneous. A second object of the present invention is to provide a control technique with which it is possible to properly handle an abnormal operation of an apparatus while satisfying various demands of users.

For the purpose of achieving the first object described above, in a toner consumption calculating method and a toner consumption calculating apparatus according to the first aspect of the present invention which calculate the amount of toner which is consumed as an image is formed on a recording medium using a toner cartridge filled with toner, the number of pixels demanding toner is counted, a cumulative count of the toner consumption is calculated, a sensor detects patch image densities, whether the cumulative count of the toner consumption is equal to or smaller than a first predetermined value and whether the result of the detection performed by the sensor is equal to or smaller than a second predetermined value is judged, and the cumulative count is corrected when the cumulative count is equal to or smaller than the first predetermined value and the detection result is equal to or smaller than the second predetermined value.

Since the cumulative count is corrected when needed according to this invention, it is possible to exchange a toner cartridge even when the count is erroneous.

For the purpose of achieving the second object described above, according to the second aspect of the present invention, in accordance with the state of toner or the apparatus, appropriate range regarding a toner amount constituting a patch image is set, and when the detected toner amount of patch image is outside the appropriate range, it is determined that there is something abnormal with the apparatus.

According to this invention, when the toner amount which constitute actually formed patch image has abnormal value, it is determined that the apparatus is in an abnormal state. With the appropriate range regarding a toner amount is set in accordance with the operation state of the apparatus, it is possible to more precisely sense the abnormality within the apparatus.

A technique for accurately calculating a toner amount which constitutes a toner image will also be described below.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 21 is a drawing of an example of the error threshold value and the control target value;

FIG. 27 is a drawing of a result of the adjustment operation in the fourth embodiment.

DETAILED DESCRIPTION OF THE PREFERRED EMBODIMENTS

<Structure of Image Forming Apparatus of the Present Invention>

Figure 1:
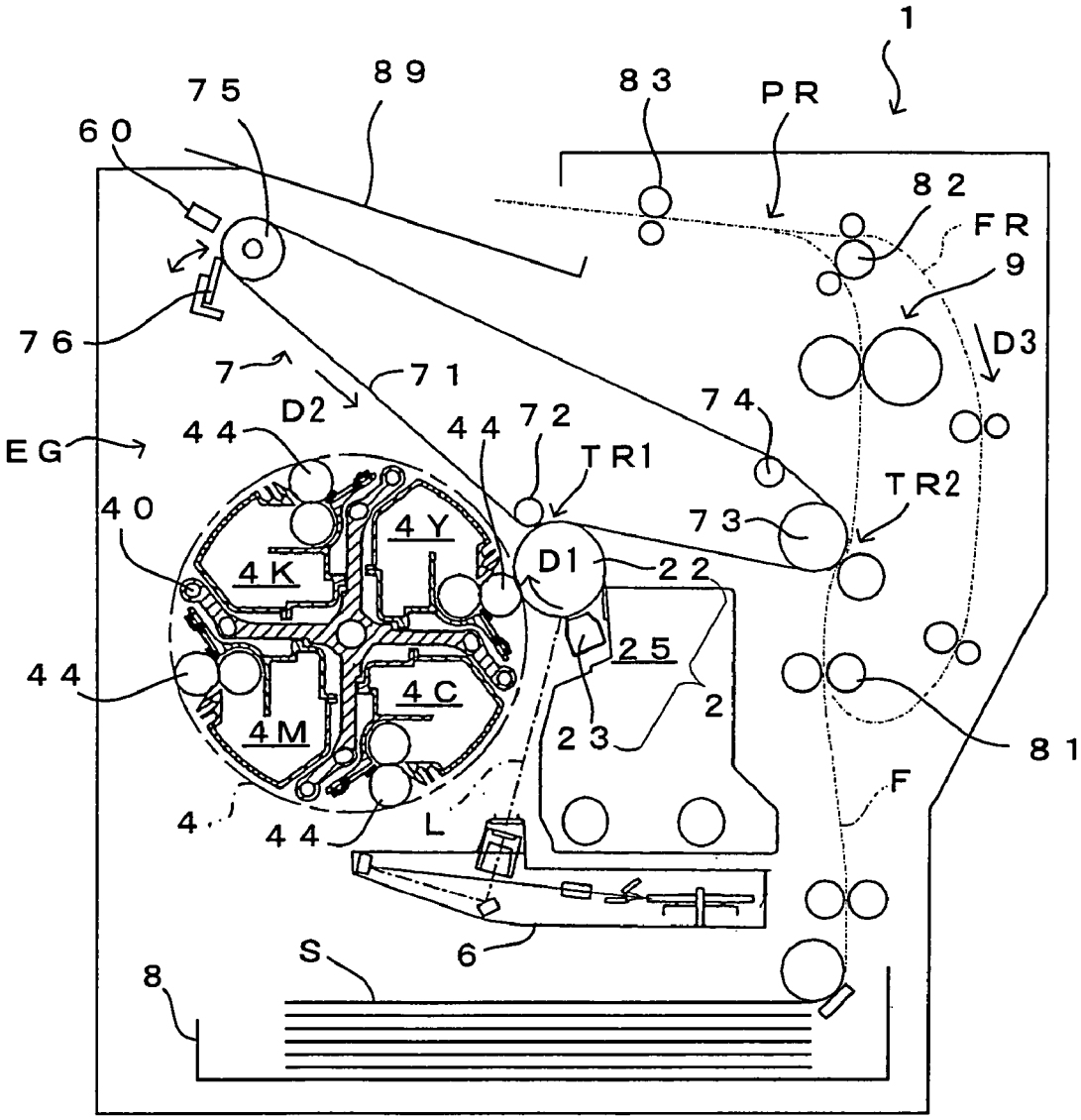
FIG. 1 is a drawing which shows the structure of an image forming apparatus according to the present invention.
Figure 2:
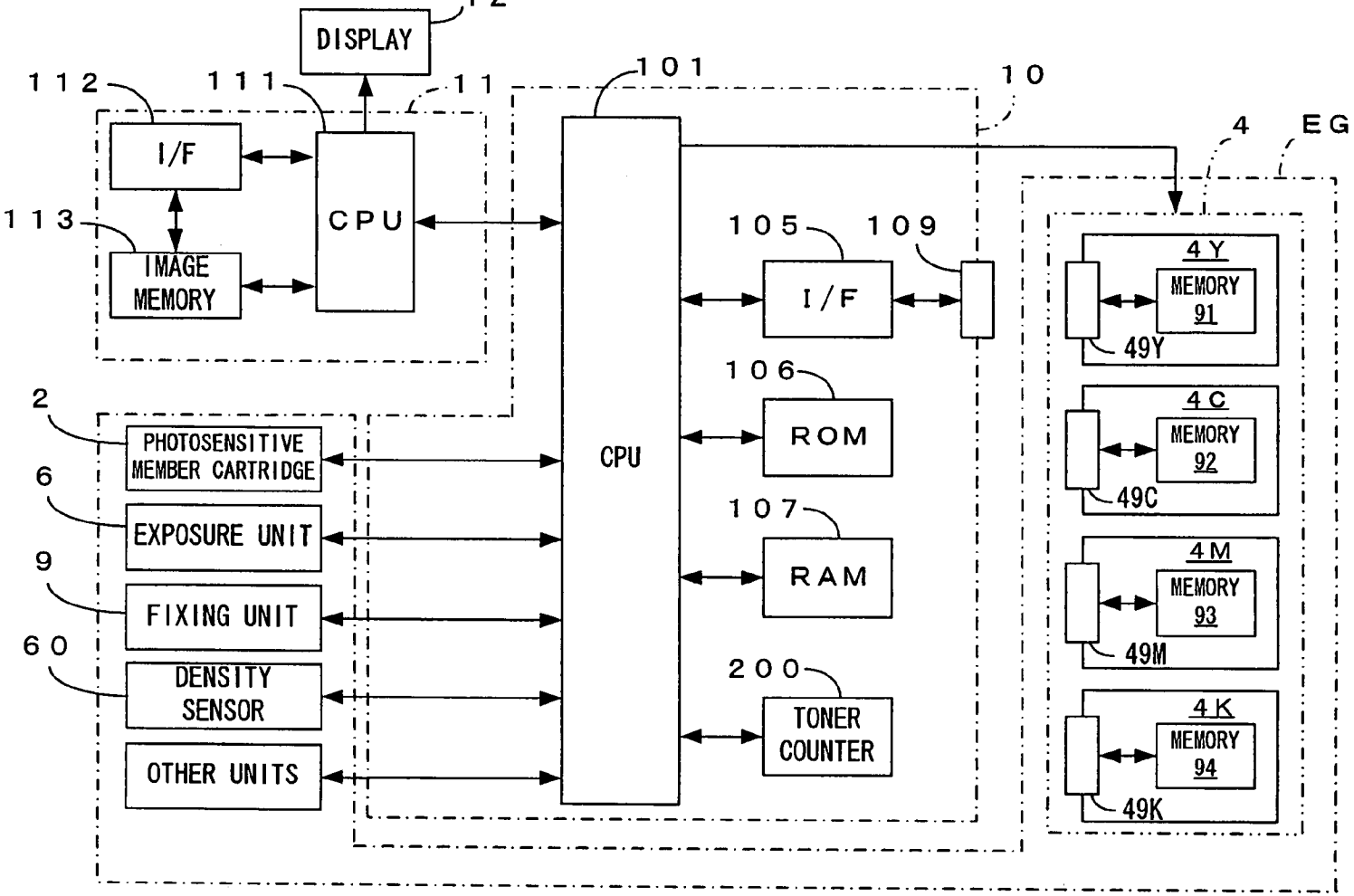
FIG. 2 is a block diagram of the electric structure of the image forming apparatus which is shown in FIG. 1.

FIG. 1 is a drawing which shows the structure of an image forming apparatus according to the present invention. FIG. 2 is a block diagram of the electric structure of the image forming apparatus which is shown in FIG. 1. The illustrated apparatus 1 is an apparatus which overlays toner in four colors of yellow (Y), cyan (C), magenta (M) and black (K) one atop the other and accordingly forms a full-color image, or forms a monochrome image using only black toner (K). In the image forming apparatus 1, when an image signal is fed to a main controller 11 from an external apparatus such as a host computer, a predetermined image forming operation is performed. That is, an engine controller 10 controls respective portions of an engine part EG in accordance with an instruction received from the main controller 11, and an image which corresponds to the image signal is formed on a sheet S.

In the engine part EG, a photosensitive member 22 is disposed so that the photosensitive member 22 can freely rotate in the arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a used toner tank which is disposed inside the cleaner 25. The photosensitive member 22, the charger unit 23 and the cleaner 25, integrated as one, form a photosensitive cartridge 2. The photosensitive cartridge 2 can be freely attached to and detached from a main section of the apparatus 1 as one integrated unit.

An exposure unit 6 emits a light beam L toward the outer circumferential surface of the photosensitive member 22 which is thus charged by the charger unit 23. The exposure unit 6 makes the light beam L expose on the photosensitive member 22 in accordance with an image signal fed from the external apparatus and forms an electrostatic latent image which corresponds to the image signal.

The developer unit 4 develops thus formed electrostatic latent image with toner. The developer unit 4 comprises a support frame 40 which is disposed for free rotations about a rotation shaft which is perpendicular to the plane of FIG. 1, and also comprises a yellow developer 4Y, a cyan developer 4C, a magenta developer 4M and a black developer 4K which house toner of the respective colors and are formed as cartridges which are freely attachable to and detachable from the support frame 40. The engine controller 10 controls the developer unit 4. The developer unit 4 is driven into rotations based on a control instruction from the engine controller 10. When the developers 4Y, 4C, 4M and 4K are selectively positioned at a predetermined developing position which abuts on the photosensitive member 22 or is away a predetermined gap from the photosensitive member 22, toner of the color corresponding to the selected developer is supplied onto the surface of the photosensitive member 22 from a developer roller 44 disposed to the selected developer which carries toner of this color and has been applied with the predetermined developing bias. As a result, the electrostatic latent image on the photosensitive member 22 is visualized in the selected toner color.

Non-volatile memories 91 through 94 which store information regarding the respective developers are disposed to the developers 4Y, 4C, 4M and 4K. As one of connectors 49Y, 49C, 49M and 49K disposed to the respective developers selected as needed is connected with a connector 109 which is disposed to the main section, a CPU 101 of the engine controller 10 and one of the memories 91 through 94 communicate with each other. In this manner, the information regarding the respective developers is transmitted to the CPU 101 and the information inside the respective memories 91 through 94 is updated and stored.

A toner image developed by the developer unit 4 in the manner above is primarily transferred onto an intermediate transfer belt 71 of a transfer unit 7 in a primary transfer region TR1. The transfer unit 7 comprises the intermediate transfer belt 71 which runs across a plurality of rollers 72 through 75, and a driver (not shown) which drives a roller 73 into rotations to thereby rotate the intermediate transfer belt 71 along a predetermined rotation direction D2. For transfer of a color image on the sheet S, toner images in the respective colors on the photosensitive member 22 are superposed one atop the other on the intermediate transfer belt 71, thereby forming a color image. Further, on the sheet S unloaded from a cassette 8 one at a time and transported to a secondary transfer region TR2 along a transportation path F, the color image is secondarily transferred.

At this stage, for the purpose of correctly transferring the image held by the intermediate transfer belt 71 onto the sheet S at a predetermined position, the timing of feeding the sheet S into the secondary transfer region TR2 is managed. To be more specific, there is a gate roller 81 disposed in front of the secondary transfer region TR2 on the transportation path F. As the gate roller 81 rotates in synchronization to the timing of rotations of the intermediate transfer belt 71, the sheet S is fed into the secondary transfer region TR2 at predetermined timing.

Further, the sheet S now bearing the color image is transported to a discharge tray 89, which is disposed to a top surface of the main section of the apparatus, through a fixing unit 9, a pre-discharge roller 82 and a discharge roller 83. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. While the sheet S is returned back to the transportation path F again before arriving at the gate roller 81, the surface of the sheet S which abuts on the intermediate transfer belt 71 in the secondary transfer region TR2 and is to receive a transferred image is at this stage opposite to the surface which already bears the image. In this fashion, it is possible to form images on the both surfaces of the sheet S.

Further, there are a sensor 60 and a cleaner 76 in the vicinity of the roller 75. The sensor 60 optically detects a toner amount which constitutes a toner image which is formed as a patch image on the intermediate transfer belt 71 when needed, as described later. The sensor 60 irradiates light toward the patch image, receives reflection light from the patch image, and outputs a signal corresponding to a reflection light amount.

The cleaner 76 can be attached to and detached from the intermediate transfer belt 71. When abutting on the intermediate transfer belt 71 as needed, the cleaner 76 scrapes off the toner remaining on the intermediate transfer belt 71 and the toner which constitutes the patch image.

Although not shown in the drawing, a cover which can be freely opened and closed is disposed to a part of the housing of the apparatus 1, such that the engine part EG described above is exposed when the cover is opened. This makes it easier for a user or a professional service person to maintain the engine part EG.

Further, as shown in FIG. 2, the apparatus 1 comprises a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, etc.

The engine controller 10 of the apparatus 1 comprises a toner counter 200 which calculates the amount of toner which is held in each developer and consumed as the apparatus operates. The structure and operation principle of the toner counter 200 will be described in detail later.

In FIG. 2, denoted at 113 is an image memory which is disposed to the main controller 11, so as to store an image which is fed from an external apparatus such as a host computer via an interface 112. Denoted at 106 is a ROM which stores a calculation program executed by the CPU 101, control data for control of the engine part EG, etc. Denoted at 107 is a memory (RAM) which temporarily stores a calculation result derived by the CPU 101, other data, etc.

The memories 91 through 94 disposed to the developers 4Y, 4C, 4M and 4K and the memory 107 disposed to the engine controller 10 are preferably non-volatile memories which are capable of holding data even when the power source is off or the developers are detached from the main section. As such non-volatile memories, flash memories, ferroelectric memories (FRAMs), EEPROMs or the like may be used.

<Structure of Sensor>

The structure of the sensor 60 which detects toner amount of a patch image density will now be described. The sensor 60 optically detects the amount of toner which has adhered as a patch image to the intermediate transfer belt 71. As a numerical value which quantatively expresses a patch image density, the CPU 101 then calculates an evaluation value of the patch image which is based on an output signal from the sensor 60.

In the image forming apparatus which has been previously proposed by the inventor of the present invention (described in Japanese Patent Application Laid-Open Gazette No. 2002-116614), the amount of toner adhering as a patch image is calculated in the following manner. That is, light is irradiated upon an image carrier, reflection light from the image carrier is split into p-polarized light and s-polarized light, the amounts of the p-polarized light and the s-polarized light are detected, and the adhering toner amount on the image carrier is calculated based on the ratio of the light amounts.

The more than one light components contained in outgoing light from the image carrier are thus detected individually. Use of these detection results achieves highly accurate measurement of the adhering toner amount which is less susceptible to an influence of a noise, an influence of variations of the amount of irradiation light upon the image carrier, etc.

However, in accordance with a technique for separately detecting more than one light components contained in outgoing light from an image carrier, the levels of detected light amounts and the size of changes of the light amounts are different between the light components. For this reason, the dynamic ranges of light amount detection values of the light components are different from each other. In addition, the detected light amount values of the light components inevitably contain measurement errors.

During calculation of the adhering toner amount based on the detected light amount values representing the more than one light components, the different dynamic ranges or the measurement errors in some cases deteriorates the accuracy, gives rise to an abnormal calculation result or otherwise hampers the calculation of the adhering toner amount. Noting this, the sensor 60 of the image forming apparatus 1 has the following structure, thereby solving these problems.

Figure 3:
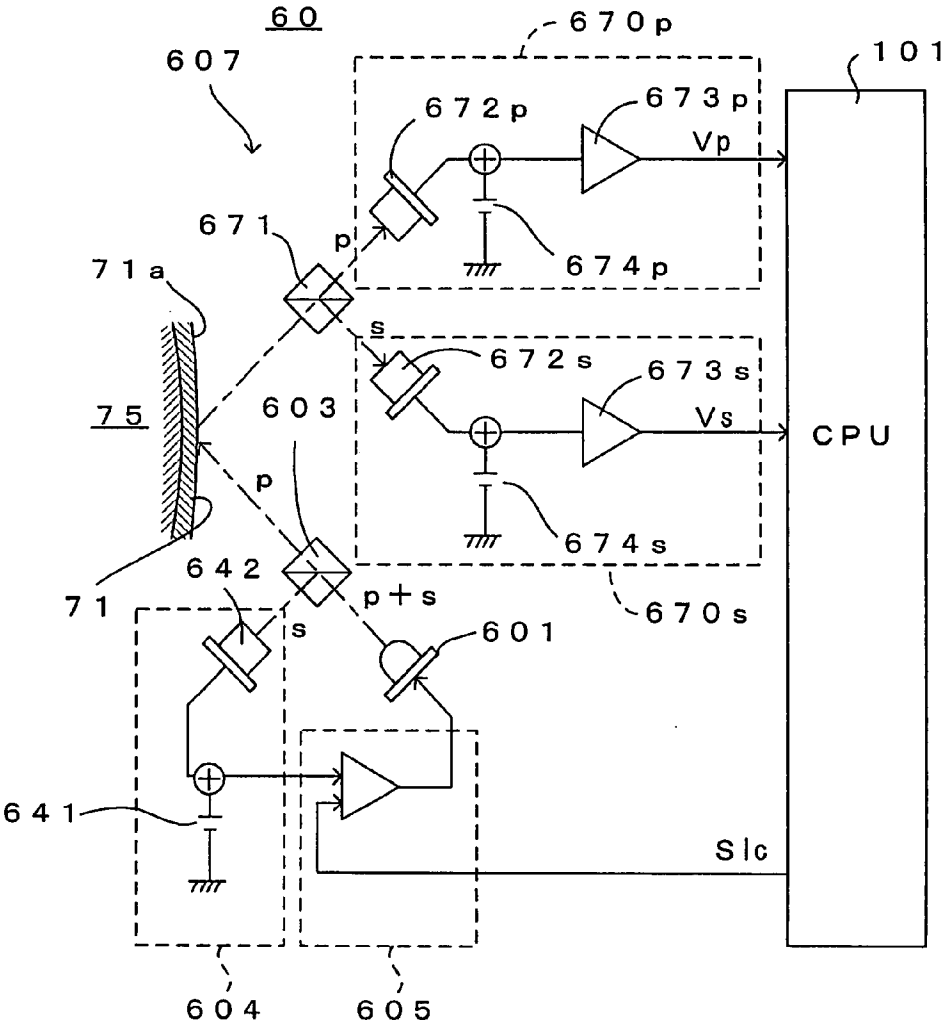
FIG. 3 is a drawing which shows the structure of the sensor.

FIG. 3 is a drawing which shows the structure of the sensor. The sensor 60 comprises a light emitter element 601 such as an LED which irradiates light upon a wound area 71*a* which corresponds to a surface area of the intermediate transfer belt 71 which lies on the roller 75. The sensor 60 also comprises a polarizer beam splitter 603, a light receiver unit 604 for monitoring irradiated light amount and an irradiated light amount adjusting unit 605, to thereby adjust the irradiated light amount of irradiation light in accordance with a light amount control signal Slc which is fed from the CPU 101 as described later.

The polarizer beam splitter 603 is, as shown in FIG. 3, disposed between the light emitter element 601 and the intermediate transfer belt 71. The polarizer beam splitter 603 splits light emitted from the light emitter element 601 into p-polarized light, whose polarizing direction is parallel to the surface of incidence of the irradiation light on the intermediate transfer belt 71, and s-polarized light whose polarizing direction is perpendicular to the surface of incidence of the irradiation light. The p-polarized light as it is impinges upon the intermediate transfer belt 71, while the s-polarized light impinges upon the light receiver unit 604 after emitted from the polarizer beam splitter 603, so that a signal which is in proportion to the irradiated light amount is outputted to the irradiated light amount adjusting unit 605 from a light receiver element 642 of the light receiver unit 604.

Based on the signal from the light receiver unit 604 and the light amount control signal Slc from the CPU 101, the irradiated light amount adjusting unit 605 feedback-controls the light emitter element 601 and adjusts the irradiated light amount of the light irradiated upon the intermediate transfer belt 71 from the light emitter element 601 into a value which corresponds to the light amount control signal Slc. According to this embodiment, the irradiated light amount can thus be changed and adjusted appropriately within a wide range, in accordance with the output signal from the CPU 101.

In the sensor 60 having this structure, an input offset voltage 641 is applied to the output side of the light receiver element 642 of the light receiver unit 604 for monitoring irradiated light amount and the light emitter element 601 is maintained off unless the light amount control signal Slc exceeds a certain signal level.

As the light amount control signal Slc having a predetermined level is fed to the irradiated light amount adjusting unit 605 is fed, the light emitter element 601 turns on and p-polarized light is irradiated as irradiation light upon the intermediate transfer belt 71. The p-polarized light is reflected by the intermediate transfer belt 71. Of light components of the reflection light, a reflection light amount detector unit 607 detects the light amount of the p-polarized light and that of the s-polarized light, and signals corresponding to the respective light amounts are outputted to the CPU 101.

As shown in FIG. 3, the reflection light amount detector unit 607 comprises a beam splitter 671 which is disposed on the optical path of the reflection light, a light receiver unit 670*p* which receives p-polarized light transmitted by the beam splitter 671 and outputs a signal which corresponds to the light amount of the p-polarized light, and a light receiver unit 670*s* which receives s-polarized light split by the beam splitter 671 and outputs a signal which corresponds to the light amount of the s-polarized light.

In the light receiver unit 670*p*, a light receiver element 672*p* receives the p-polarized light from the beam splitter 671, and after an amplifier circuit 673*p* amplifies an output from the light receiver element 672*p*, and the light receiver unit 670*p* outputs the resulting amplified signal as a signal which corresponds to the light amount of the p-polarized light. Meanwhile, like the light receiver unit 670*p*, the light receiver unit 670*s* comprises a light receiver unit 672*s* and an amplifier circuit 673*s*. Hence, it is possible to independently calculate the light amounts of the light containing the mutually different two components (the p-polarized light and the s-polarized light) among the light components of the reflection light.

Further, in the sensor 60, output offset voltages 674*p* and 674*s* are respectively applied to the output side of the light receiver elements 672*p* and 672*s*, and output voltages Vp and Vs of the signals fed to the CPU 101 from the amplifier circuits 673*p* and 673*s* are offset to the positive side.

Figure 4:
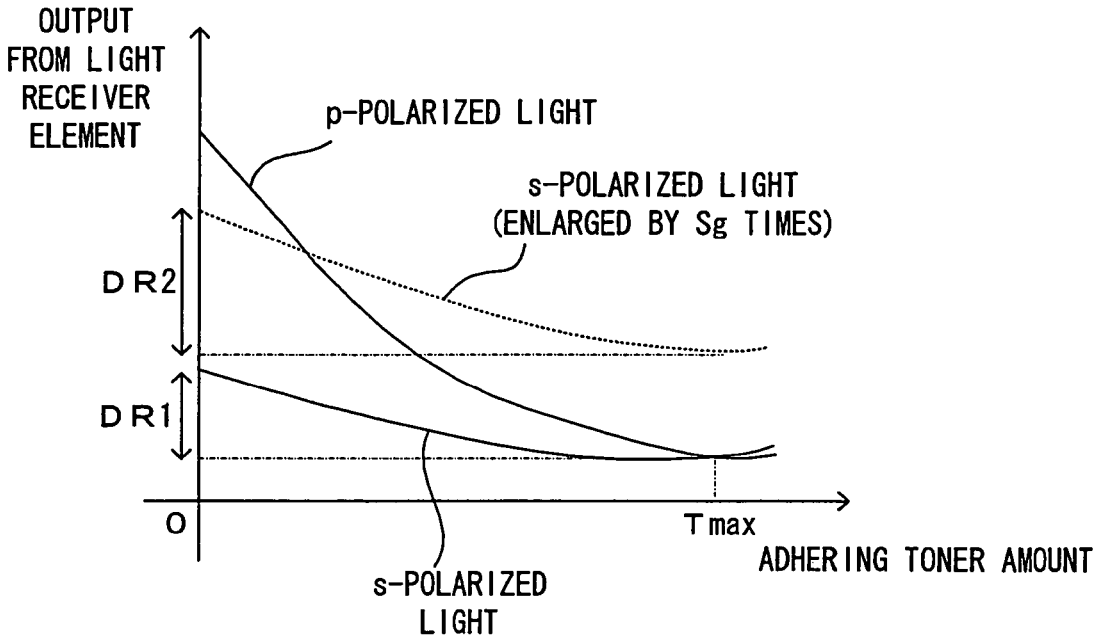
FIG. 4 is a drawing which shows an example of output characteristics of the light receiver elements.

FIG. 4 is a drawing which shows an example of output characteristics of the light receiver elements. Since toner absorbs and scatters the irradiation light from the sensor 60, as shown in FIG. 4, the output voltage at the light receiver element 672*p*, which corresponds to the p-polarized light component, i.e., the same polarized light component as the irradiation light, becomes lower as the amount of toner adhering to the surface area 71*a* the intermediate transfer belt increases.

On the other hand, since the s-polarized light component is merely a part of the light components created by scattering of the irradiation light, the output voltage at the light receiver element 672*s* which corresponds to the s-polarized light component is at a lower level than the output from the light receiver element 672*p* and changes in only a small amount relative to the amount of toner. In short, as for the s-polarized light component, the dynamic range DR1 of the output signal from the light receiver element 672*p* relative to a toner amount change is narrow. Further, in the vicinity of an adhering toner amount Tmax, the output voltages at the light receiver elements 672*p* and 672*s* are at approximately equal levels.

In this sensor, a ratio Sg of the gain of the amplifier circuit 673*s* to that of amplifier circuit 673*p* is set as: Sg=3. In other words, the gain on the s-polarized light component is three times as large as the gain on the p-polarized light component, thereby virtually raising the level at the light receiver element 672*s* as denoted at the dotted line in FIG. 4 and expanding the dynamic range to DR2. Since this also increases the level of the output voltage Vs from the sensor 60, an electric noise coming from a peripheral circuit is less influential.

The sensor 60 will now be described further with reference back to FIG. 3. In the light receiver units 670*p* and 670*s* having such structures, as in the case of the light receiver unit 604, the output voltages Vp and Vs have values equal to or larger than zero even when the reflection light amount is zero, and the output voltages Vp and Vs increase in proportion to an increase of the reflection light amount. Thus, application of the output offset voltages 674*p* and 674*s* securely eliminates an influence of dead zones (i.e., areas where input voltages are close to zero and not in proportion to output voltages) of the amplifier circuits 673*p* and 673*s* which operate in a single-polarity supply operation, and accordingly ensures that output voltages corresponding to the reflection light amount are outputted.

In the image forming apparatus 1 comprising the sensor 60 having structure above, the amount of adhering toner which constitutes a toner image formed on the intermediate transfer belt 71 is detected in the following manner. The adhering toner amount is detected while the CPU 101 controls the respective portions of the apparatus when necessary, e.g., when a patch image is formed and an image forming condition is controlled based on the density of the patch image.

Figure 5:
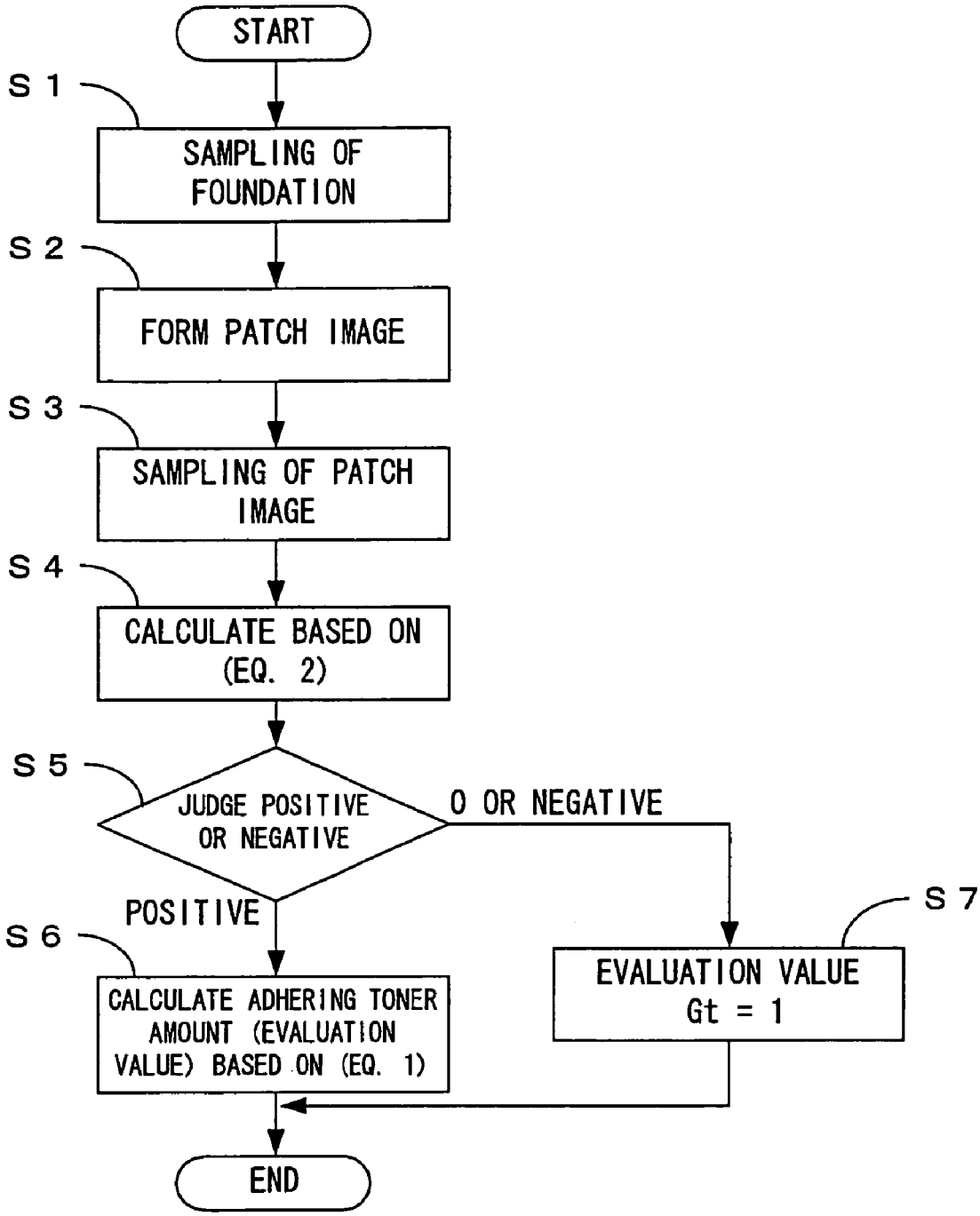
FIG. 5 is a flow chart of an adhering toner amount detecting process.

FIG. 5 is a flow chart of an adhering toner amount detecting process. First, to grasp the surface condition of the intermediate transfer belt 71, foundation sampling is conducted (Step S1). That is, before forming a toner image, light from the sensor 60 is irradiated upon the surface area 71*a* of the intermediate transfer belt 71 while moving the intermediate transfer belt 71, the output voltages Vp and Vs from the sensor 60 at this time are sampled at constant time intervals. The resultant sampling data are stored, thereby obtaining information regarding stain, discoloration and the like of the intermediate transfer belt 71 which serves as the foundation for the toner image.

Time and spatial intervals of sampling may be determined appropriately in accordance with the size of the detection spot of the sensor 60 (i.e., the size of the surface area of the intermediate transfer belt 71 estimated by the reflection light amount detector unit 607), the speed at which the intermediate transfer belt 71 moves, etc. As for the number of samples, sampling may be conducted over the length of one round of the intermediate transfer belt 71, or alternatively, sampling may be conducted only in a region where a toner image is to be formed described later.

Next, a toner image having a predetermined pattern is formed as a patch image while controlling the engine part EG and then transferred onto the surface of the intermediate transfer belt 71 (Step S2). As one example, it is assumed here that the image is a solid image.

With respect also to thus formed patch image, the output voltages Vp and Vs from the sensor 60 are sampled (Step S3) and the sampling result is stored. While the result of sampling at any point of a solid image should be the same, considering a density variation which arises as an image is formed, a variation attributed to a measurement error and the like, sampling is conducted at a plurality of positions within the solid image and the averages of these are calculated so that an influence of such variations will be suppressed. The results of foundation sampling are handled similarly. The average values of the sensor output voltages Vp and Vs sampled on the patch image will hereinafter referred to as Vdp_ave and Vds_ave. Meanwhile, the average values of the sensor output voltages Vp and Vs resulting from sampling of the foundation (which is the surface of the intermediate transfer belt 71 as it is before toner image formation) will hereinafter referred to as Vtp_ave and Vts_ave.

The subsequent steps S4 and S5 will be described later. A predetermined calculation is then performed on the sampling results of the foundation and the patch image thus obtained, thereby obtaining an evaluation value Gt of the patch image as the result of the calculation (Step S6).

The evaluation value Gt is supposed to correspond to the adhering toner amount of the toner image on the intermediate transfer belt 71 on the one-on-one basis in principle, and hence supposed to be a value which serves as an index of the image density of the patch image. In short, the evaluation value Gt is defined in such a manner that the evaluation value Gt is 0 when there is no toner adhering to the intermediate transfer belt 71, the evaluation value Gt grows as the adhering toner amount increases and the evaluation value Gt is 1 when the adhering toner amount is maximum and it is not therefore necessary to make toner adhere any more considering the design. To be specific, the evaluation value Gt is calculated as follows:

$$Gt=1-\{Sg\cdot(Vdp_ave-Vp0)-(Vds_ave-Vs0)\}/\{Sg\cdot(Vtp_ave-Vp0)-(Vts_ave-Vs0)\} \quad \text{(Eq. 1)}$$

In the formula above, Vp0 and Vs0 denote the voltages Vp and Vs sampled with the light emitter element 601 of the sensor 60 turned off. As shown in FIG. 3, since the output offset voltages 674*p* and 674*s* are applied to the output side of the light receiver elements 672*p* and 672*s*, the sensor 60 outputs predetermined positive voltages as the output voltages Vp and Vs even when the light emitter element 601 is off. The values Vp0 and Vs0 above are output voltages at this stage, and therefore, as the values Vp0 and Vs0 are subtracted from the respective sampling data (or the average values of the same), changes of the output voltages corresponding to the detected light amounts are obtained.

Further, the term corresponding to the p-polarized light component is multiplied by the value Sg, whereby a gain difference between the amplifier circuits 673*p* and 673*s* which form the sensor 60 is compensated for. This allows the following calculation based on the true light amount difference between the two light components.

In this case, when the adhering toner amount is large, the two outputs Vp and Vs of the sensor 60 are smaller as compared with where the adhering toner amount is small, as shown in FIG. 4. This means that the larger the adhering toner amount is, the closer the numerator in the right-hand side second term of (Eq. 1) becomes to zero:

$$Sg\cdot(Vdp_ave-Vp0)-(Vds_ave-Vs0) \quad \text{(Eq. 2)}$$

The use of the sensor 60 which exhibits the characteristic shown in FIG. 4 is the very reason why the evaluation value Gt becomes 0 when the adhering toner amount on the intermediate transfer belt 71 is minimum but becomes 1 when the adhering toner amount is maximum in this image forming apparatus 1. In other words, as shown in FIG. 4, a difference between the outputs from the light receiver elements corresponding respectively to the p-polarized and the s-polarized light components becomes maximum when the adhering toner amount is zero, decreases as the adhering toner amount increases and becomes zero when the adhering toner amount is Tmax. This embodiment uses such a sensor 60 which ensures that the adhering toner amount Tmax, which makes the outputs from the light receiver elements corresponding to the two polarized light components approximately equal to each other, is about the same as the maximum adhering toner amount which is needed by this image forming apparatus. However, speaking in a more general sense, a maximum adhering toner amount in an image forming apparatus does not always coincide with an adhering toner amount which makes the value yielded from (Eq. 2) zero. Hence, the evaluation value Gt calculated from (Eq. 1) may exceed 1 or become a negative value.

Thus, the subsequent processing becomes complex when the evaluation value Gt indicative of the adhering toner amount is within too large a range or when the evaluation value Gt may possibly become a positive or negative value. Noting this, in the event that the maximum adhering toner amount in the image forming apparatus is largely different from the adhering toner amount which makes the value yielded from (Eq. 2) zero because of use of other sensor, the weighting factor in the first term of (Eq. 2) may have a different value from the gain ratio Sg on the two polarized light components within the sensor.

Figure 6:
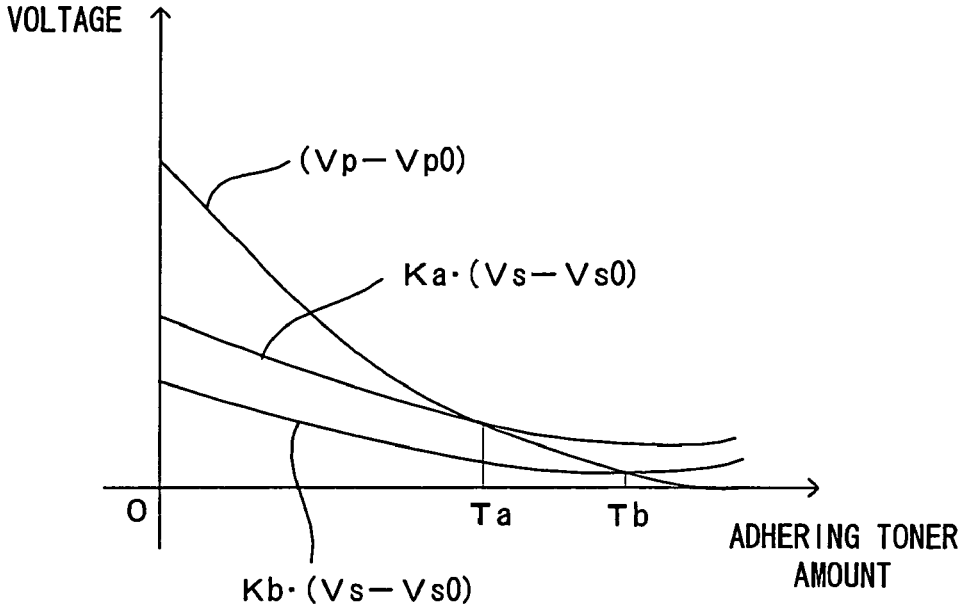
FIG. 6 is a drawing which shows a relationship between weighting factors and sensor outputs.

FIG. 6 is a drawing which shows a relationship between weighting factors and sensor outputs. This will now be described on the assumption that the output corresponding to the s-polarized light component is multiplied by the weighting factor. As shown in FIG. 6, when a weighting factor Ka (>0) is used for instance, the value yielded from (Eq. 2) is zero at the adhering toner amount Ta. On the other hand, when a weighting factor Kb (0<Kb<Ka) is used for example, the value yielded from (Eq. 2) is zero at the adhering toner amount Tb.

In short, as the weighting factor is changed, the value of the adhering toner amount in response to the value yielded from (Eq. 2) becomes zero also changes. Hence, as the weighting factor appearing in (Eq. 2) is set such that the adhering toner amount which makes the value yielded from (Eq. 2) zero is the maximum adhering toner amount in the image forming apparatus, the value resulting from (Eq. 2) is always zero or positive, and therefore, the evaluation value Gt expressed by (Eq. 1) is a value from 0 to 1.

In this embodiment, since the maximum adhering toner amount in the apparatus is approximately the same as the adhering toner amount Tmax mentioned above within the sensor 60, the weighting factor is the gain ratio Sg on the two polarized light components within the sensor 60.

Despite this, this value may become negative when the sampling results are substituted in (Eq. 2), owing to variations of the sensitivities of the light receiver elements, measurement errors inevitably contained in sampling data, etc. In consequence, the evaluation value Gt expressed by (Eq. 1) may exceed 1. It is inconvenient that such a result arises although the definition has been given such that the evaluation value Gt would be 0 through 1. Where a processor of the fixed-point arithmatic type is used for calculations in particular, a calculation yielding a result exceeding 1 may lead to an abnormal result.

In light of this, prior to the calculation according to (Eq. 1) at Step S6, the value yielded from (Eq. 2) above is calculated and the sign of the value is judged (Step S4 and Step S5). When the value is zero or negative, forgoing the calculation based on (Eq. 1) and assuming that toner has adhered in an enough amount, it is determined that the evaluation value Gt is 1 (Step S7). The reason why this is acceptable will now be described with reference to FIG. 7.

Figure 7:
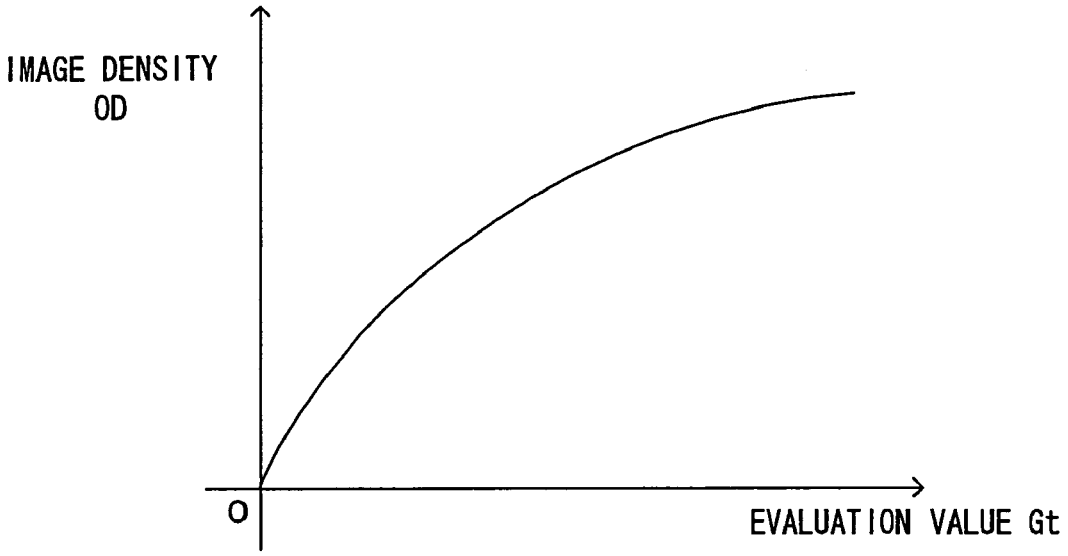
FIG. 7 is a drawing which shows one example of a relationship between the evaluation value of a toner image and the optical density of the toner image.

FIG. 7 is a drawing which shows one example of a relationship between the evaluation value of a toner image and the optical density of the toner image. As described earlier, the evaluation value Gt is a value which is indicative of the adhering toner amount on the intermediate transfer belt 71. The optical density of a toner image (optical density OD) on the recording medium is somewhat affected by whether the adhering toner amount is large or small. When the relationship between the evaluation value and the image density is plotted, as shown in FIG. 7, the gradient is less steep within a region where the evaluation value Gt is large, that is, where the adhering toner amount is large than in a region where the adhering toner amount is small. In other words, in the region that the adhering toner amount is large, a variation of the adhering toner amount is less noticeable as a change of the density of the toner image.

Further, as shown in FIG. 4, the light amount of the s-polarized light component contained in scattered light from the toner image does not monotonously decrease in accordance with an increase in adhering toner amount but may start increasing sometimes. Due to this, in the event that toner has adhered in an amount beyond the adhering toner amount Tmax, the output signal corresponding to the s-polarized light component becomes larger than the other and the value yielded from (Eq. 2) consequently becomes negative.

In any case, the situation is that toner has adhered in an enough amount to obtain a necessary image density, and there is not a great practical advantage in calculating the adhering toner amount over and above what is needed. When the result of (Eq. 2) is negative therefore, it may be determined that toner has sufficiently adhered and the subsequent calculation may be skipped. When the result of (Eq. 2) is zero, since the evaluation value Gt remains 1 regardless of whether the next processing step is Step S6 or Step S7, Step S7 which omits the calculation will be then executed in this embodiment.

In the manner above, the amount of toner adhering as a toner image on the intermediate transfer belt 71 is calculated. Bias voltages applied upon the respective portions of the apparatus, a tone correction characteristic and the other are adjusted using the result of the calculation, whereby a stable image quality is maintained in this embodiment.

As described above, the sensor 60 irradiates light having a single component of the p-polarized light component upon the surface area 71*a* of the intermediate transfer belt 71, and separately detects, of light coming from the surface area 71*a*, the p-polarized light component which is the same polarized light as the irradiation light and the s-polarized light component which is orthogonal to the irradiation light. At this stage, since gains in response to output signals from the light receiver elements 672*p* and 672*s* which correspond to the light amounts of these two polarized light components are different from each other in accordance with the signal levels of the respective output signals, dynamic ranges of the output signals are ensured.

When it is determined that toner has adhered in an enough amount in the middle of the calculation, since it has been determined that the toner amount is sufficient and the subsequent calculation can be omitted, it is possible to efficiently calculate the adhering toner amount without executing the unnecessary calculation.

The structure of the sensor 60 is not limited to the structure above, but may be modified in various manners other than the structure above to the extent not deviating from the intention of the sensor 60. For example, although the sensor 60 described above irradiates light containing only the p-polarized light component and receives, as the two light components to be received, the p-polarized light whose plane of polarization is the same as that of the irradiation light and the s-polarized light component whose plane of polarization is vertical to that of the irradiation light, the sensor may emit and receive light having a different property. As an alternative for the s-polrized light component, all other light components than the p-polarized light component may be used, for instance.

Further, for example, although the evaluation value Gt is introduced as a value which is indicative of the adhering toner amount or the image density in this image forming apparatus 1, any other value which is indicative of the adhering toner amount may be used such as the density of toner on the intermediate transfer belt 71 and a numerical value converted into an image density. In addition, the formula for calculation of the evaluation value Gt described above is merely one example, and other appropriate calculation formula may be introduced in accordance with a purpose.

Further, the sensor 60 detects the adhering toner amount of a toner image formed on the intermediate transfer belt 71 in this apparatus 1 for example, as an alternative to this, the adhering toner amount of a toner image formed on the surface of the photosensitive member 22 for instance may be detected.

<Structure of Toner Counter>

Figure 8:
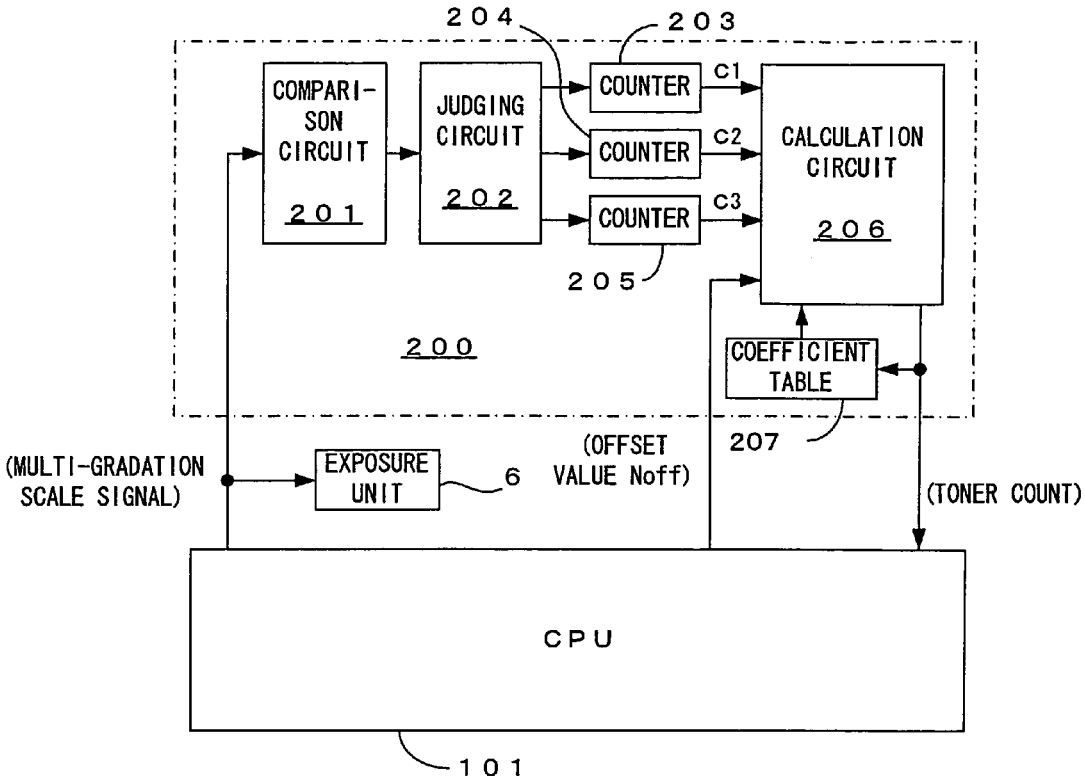
FIG. 8 is a block diagram of the structure of the toner counter.

The structure and the operation of the toner counter 200 will now be described. FIG. 8 is a block diagram of the structure of the toner counter. In this apparatus, based on a program stored in the ROM 106 which is shown in FIG. 2, the CPU 101 executes a predetermined calculation and a toner consumption which is required by image formation is calculated. That is, although all of the structure as the toner counter 200 is realized by software of the CPU 101, the toner counter 200 can be configured by hardware.

Shown in FIG. 8 is an example of the circuit structure which is configured by hardware. The operation principle of the toner counter within the image forming apparatus 1 will now be described, while referring to the toner counter 200 having a hardware structure shown in FIG. 8 as a model. When the structure shown in FIG. 8 is realized by software, a toner consumption can be calculated based on similar principle to that for where the structure is realized by hardware.

Within this toner counter 200, based on the same signal as that fed to the exposure unit 6 from the CPU 101, i.e., an image signal supplied from an external apparatus, the main controller 11 performs predetermined signal processing and a tone signal developed into tone values for the respective toner colors is supplied. Based on a control signal, a comparison circuit 201 passes only those signals which correspond to print dots where the tone values are at or beyond a predetermined threshold value, and these signals are fed to a judging circuit 202. The judging circuit 202 judges the arrangement of the print dots based on an output signal from the comparison circuit 201.

The judging circuit 202 detects the number of dots which constitute a print dot string, classifies dots into three patterns of dots, i.e., dots having the tone value equal to or larger than the threshold value, 4-continuous dots and isolated dots. Then the judging circuit 202 outputs "1" to any one of counters 203 through 205 depending on the pattern. Isolated dots are those dots which have the tone levesl equal to or larger than the threshold value and have no neighboring dots having equal to or larger than the threshold value. These counters 203, 204 and 205 are disposed corresponding to the respective three patterns:dots having the tone value equal to or larger than the threshold value; 4-continuous dots; and isolated dots. The counters 203 through 205 count a signal outputted from the judging circuit 202 when needed, and hence, the number of times that print dot strings of these patterns are formed.

For example, when the control signal fed to the comparison circuit 201 corresponds to an isolated dot, the judging circuit 202 identifies that the dot to print is an isolated dot from the output signal from the comparison circuit 201. The judging circuit 202 then outputs "1" to the counter 205 but "0" to the other counters 203 and 204. Through such processing, only the count of the counter 205 which shows the number of times that isolated dots are formed is increased by 1.

However, the counts registered in the other counters 203 and 204 do not change at this stage. In a similar fashion, when the control signal fed to the comparison circuit 201 corresponds to 4-continuous dots, the count of the corresponding counter 204 is increased by 1 at a time. The number of times that print dots of each pattern are formed is thus counted individually.

Counts C1, C2 and C3 counted by the counters 203, 204 and 205 are fed to a calculation circuit 206. In addition to the counts C1, C2 and C3, the calculation circuit 206 receives an offset value Noff for each color fed from the CPU 101 and output values from a coefficient table 207. An output from the calculation circuit 206 is fed to the CPU 101 and the coefficient table 207. A plurality sets of numerical values serving as candidate for weighting factors Kx, K1, K2 and K3 (Eq. 3 below) are stored in the coefficient table 207 in advance, and one set out of these is selected in accordance with the output value from the calculation circuit 206. The offset value Noff corresponds to the estimated amount of toner which is consumed during the image forming operation but not used to form the image, such as the toner dropped from the developing roller into the apparatus.

The calculation circuit 206 multiplies the counts C1, C2 and C3 outputted respectively by the counters 203 through 205 by the weighting factors K1, K2 and K3 selected and outputted by the coefficient table 207, and calculates the sum of these.

Further, the offset value Noff supplied from the CPU 101 is added to the product of the sum mentioned above and the coefficient Kx. Through this calculation, the toner consumption defined as (Eq. 3) (i.e., a first toner consumption) is calculated:

$$(\text{toner consumption})=Kx\cdot(K1\cdot C1+K2\cdot C2+K3\cdot C3)+Noff \quad \text{(Eq. 3)}$$

where Kx is a color-dependent coefficient which is different between the different colors. In this manner, the toner amount consumed in the predetermined period during the image forming operation performed in response to the image signal fed from the external apparatus.

The CPU 101 reads the offset value associated with formation of the "internal" images based on not the external signal but the internal pattern data memorized in the memory 107, such as the patch image. The CPU 101 sums the offset values corresponding to the toner consumption in the formation of each internal image, as a second toner consumption. Thus yielded second toner consumption is added to the first toner consumption according to (Eq. 3), whereby the total toner consumption (a third toner consumption) is calculated.

In the toner counter 200, the offset values regarding the patch image thus calculated are added to each other and the total toner consumption is calculated. Hence, it is possible to accurately calculate the toner consumption in each color. Using the toner consumption calculated in this manner, the life of the cartridge for each color is managed precisely.

In this embodiment, the functions of the toner counter 200 are realized by software as described above. The apparatus is completed in a simple structure in this design without adding any particular hardware for calculation of toner consumption, thereby reducing the cost for the apparatus.

As described above, since the toner counter 200 is used, in the image forming apparatus which forms an image with toner in the plurality of colors on a recording medium, a toner consumption is calculated accurately in accordance with the actual condition of image formation. Further, a toner consumption is calculated accurately also in an image forming apparatus which uses an intermediate transfer member.

<Technique of Effectively Managing the Apparatus>

In the image forming apparatus 1 having the structure above, the state of the apparatus gradually changes as the apparatus is used more and more. For example, the photosensitive member 22 is worn gradually and the characteristic of the photosensitive member 22 changes. Meanwhile, toner stored within the respective developers gradually decreases. As the state of the apparatus thus changes, the quality of images also gradually change. Hence, to stably form an image having an excellent quality, it is necessary that such a management technique is established with which it is possible to always grasp the state of the apparatus and those of consumables in particular and maintenance work is done when needed. Four preferred embodiments regarding such a management technique will now be described.

First Embodiment

This embodiment is directed to an apparatus and a method of toner consumption calculation and an image forming apparatus with which it is possible exchange a toner cartridge even when a cumulative count of the toner consumption contains an error.

In an image forming apparatus which forms an image using toner, for the purpose of maintenance for toner supply, maintenance of an image quality and the like, it is necessary that toner consumption or remaining amounts are confirmed and the life of a toner cartridge is managed. The inventor of the present invention has already disclosed a toner consumption calculating method and a toner consumption calculating apparatus with which it is possible to calculate a toner consumption at a favorable accuracy using a simple structure (Japanese Patent Application Laid-Open Gazette No. 2002-174929).

The value of a print dot and a toner consumption during image formation are not only in a non-linear relationship and but changes depending upon the conditions of adjacent prints dots to this print dot. Due to this, according to the detection method and the apparatus described in the literature mentioned above, print dot strings are classified into three patterns of isolation dots, 2-continuous dots and intermediate value dots. For each one of these patterns, the toner counter counts the number of formed dots and toner consumption is calculated based on thus obtained counts.

In such an image forming apparatus, as images are formed repeatedly, toner in the toner cartridges gets consumed and gradually decreases. As the amount of toner in the toner cartridge decreases beyond a certain level, the display of the image forming apparatus shows a message such as "Please exchange the toner cartridge." to thereby encourage the user to exchange the toner cartridge.

In an effort to make an effective use of the resources, users wish to accurately grasp the remaining toner amount and exchange the toner cartridge at a proper time. The invention described in the literature above requires that the arrangement patterns of print dot strings are classified into three types and a toner consumption per page or during a certain job period is calculated from the arrangement pattern of a print dot string. In other words, the amount of toner which is actually consumed within an image forming region of a recording medium is detected, a cumulative toner consumption from the initial value of toner held in the toner cartridges is subtracted, and the remaining toner amount is calculated.

Figure 9:
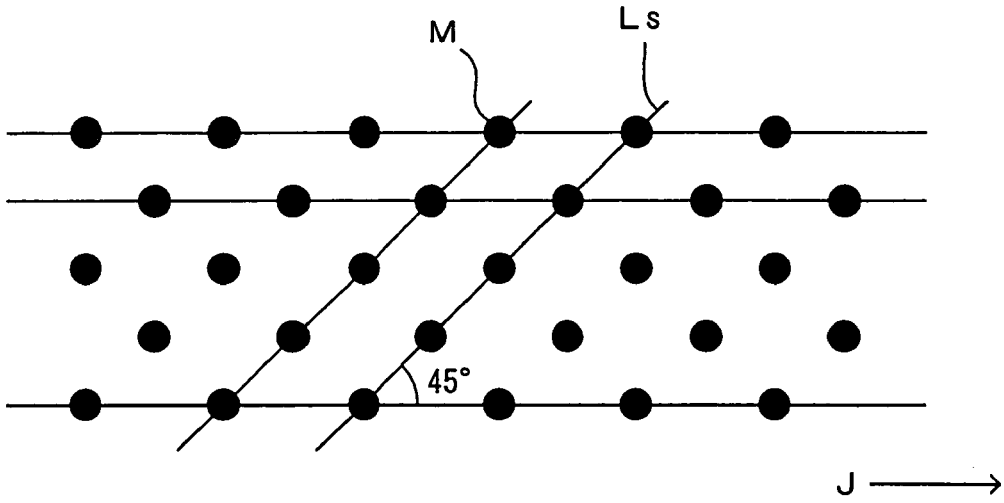
FIG. 9 is an explanatory diagram which shows an example of a screen having a halftone dot structure.

By the way, in an image forming apparatus of this type, a dither method, a density pattern method or the like is used to reproduce a halftone image. At this stage, image processing using a screen having a halftone dot structure is performed. FIG. 9 is an explanatory diagram which shows an example of a screen having a halftone dot structure. In FIG. 9, the symbol J denotes a main scanning direction while the symbol M denotes pixels. In this example, the inclined lines Ls within the screen which connect the pixels M are at an angle of 45 degrees with respect to the main scanning direction J.

According to the technique described in the literature above, a toner counter calculates a toner consumption per page or during a certain job period based on the arrangement pattern of a print dot string. For detection of dots, at a position where the arrangement pattern of a print dot string changes, e.g., a position at which there is a change from an isolated dot to a continuous dot, the read accuracy of the toner counter deteriorates and some dots may therefore fail to be detected.

Further, during the image processing which uses the screen having the halftone dot structure mentioned above, the gaps between the pixels M which are linked by the inclined lines Ls may be set narrow in some cases. When this occurs, the pixels overlap with each other, and therefore, dot detection may fail while the toner counter scans the pixels in the main scanning direction and counts a toner consumption.

In this manner, there are some cases that the toner counter fails to detect print dots and the cumulative count registered in the toner counter contains an error. This gives rise to a problem that it is not possible to accurately and properly calculate a toner consumption and precisely manage the life of the toner cartridge.

Noting this, there is a demand for a toner consumption calculating apparatus and a toner consumption calculating method with which it is possible exchange a toner cartridge even when the cumulative count registered in a toner counter contains an error. This embodiment meets this demand.

First, a method of calculating the remaining toner amount for each one of the developers (toner cartridges) 4Y, 4M, 4C and 4K will now be described. As an image forming apparatus of this type, such a model of the apparatus has been developed in which toner cartridges having two different types of capacities, namely, a cartridge having a large toner capacity and a cartridge having a small toner capacity are exchanged within and mounted to the same apparatus. In the case of such a model, the toner cartridge has a different life depending upon whether the cartridge has the large capacity or the small capacity. That is, a predetermined value of the remaining toner amount in the toner cartridge which needs to be exchanged is set to different values between the large-capacity cartridge and the small-capacity cartridge for the same color.

Figure 10:
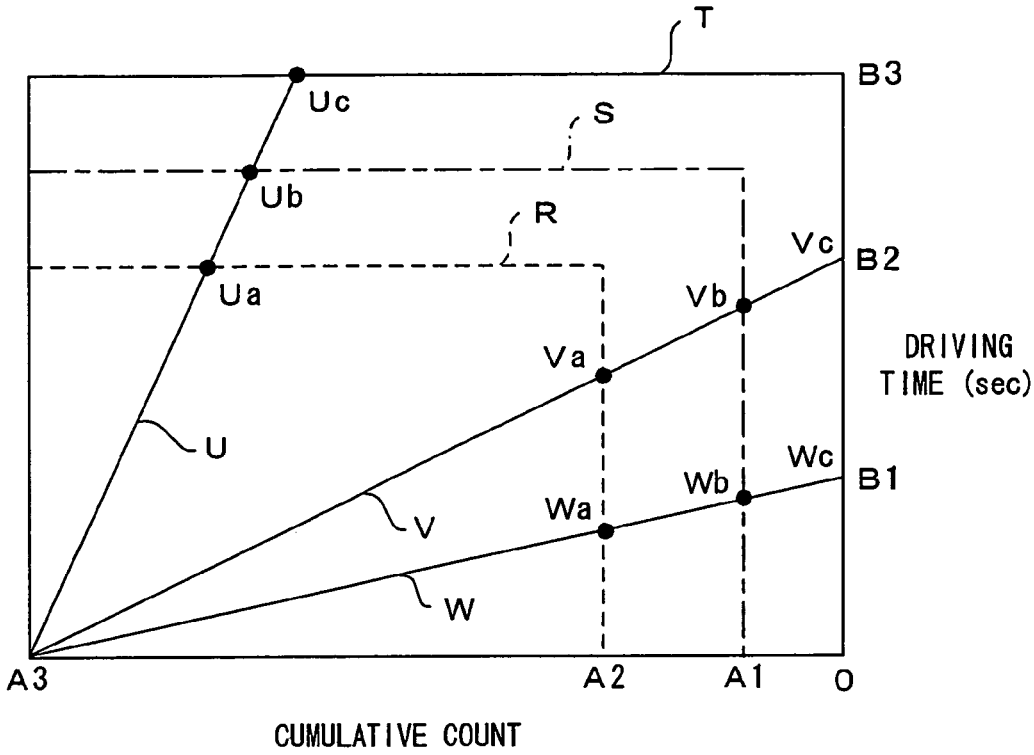
FIG. 10 is a characteristic diagram which shows the basic structure for management of the life of a toner cartridge.

FIG. 10 is a characteristic diagram which shows the basic structure for management of the life of a toner cartridge. In FIG. 10, the horizontal axis denotes the cumulative count of the toner consumption. The vertical axis denotes the driving time of the developer roller (cumulative seconds). As for the large-capacity cartridge for forming images equivalent to 6,000 pages of A4-size (in accordance with the Japanese Industrial Standards) papers, the maximum count along the horizontal axis is set to a value of thirteen millions for example.

Meanwhile, as for the small-capacity cartridge which is mounted to the same apparatus and used to form images equivalent to 2,000 pages of A4-size papers, the maximum count along the horizontal axis is set to a value of five millions. According to the present invention, regardless of whether the large-capacity cartridge is used or the small-capacity cartridge is used, it is possible to properly manage the life of the toner cartridge.

The driving time of the developer roller along the vertical axis is set to the maximum value of 12,000 seconds for instance as for the large-capacity cartridge. Meanwhile, as for the small-capacity cartridge, the driving time of the developer roller is set to the maximum value of 4,000 seconds for example. The life of the toner cartridge is judged based on whether any one of the cumulative count measured along the horizontal axis and the driving time of the developer roller measured along the vertical axis has reached a predetermined value. In other words, the life of the toner cartridge is judged in accordance with OR which represents whether any one of the cumulative count and the driving time of the developer roller has reached the predetermined value.

In the example shown in FIG. 10, at the time of judging the life of the toner cartridge, three levels are set in accordance with the remaining toner amount. That is, (1) a level at a near-end value, (2) a level at an end value and (3) a level at an end-end value are set in this order in accordance with a progressively smaller remaining toner amount. As the remaining toner amount decreases down from the initial value to (1) the level at the near-end value, the display shows a warning message, such as "The remaining toner amount has become small." and "The timing to exchange the toner cartridge is coming soon."

While the level of the remaining toner amount is from the near-end value to the end value (hereinafter referred to as the "near-end state"), although the remaining toner amount has become small, this is not influential enough over the quality of an image. However, provided with such a warning at this timing, a user can enjoy the following benefit. That is, although a toner cartridge for replacement may not always be readily available to the user, noting such a warning, the user can prepare a new cartridge before the shortage of toner starts deteriorating the quality of images.

As the remaining toner amount reduces further down to (2) the level at the end value from (1) the level at the near-end value, the display shows an operation call (ope-call) such as "Please exchange the toner cartridge." While the level of the remaining toner amount is from the end value to the end-end value (hereinafter referred to as the "end state"), there is a possibility that the shortage of toner starts will deteriorate the quality of images. In light of this, a function of displaying the ope-call above every time an image is formed on one sheet and thereby prohibiting continuous formation of images may be additionally implemented. In short, when the user has entered a predetermined operation with the knowledge that the quality of an image could deteriorate, formation of only one image may be permitted.

When the remaining toner amount has reduced further and reached (3) the level at the end-end value, control is executed so that formation of an image on a sheet will not be possible. In this manner, in the example shown in FIG. 10, the timing of exchanging the toner cartridge is set over the three levels in accordance with the remaining toner amount. The user can thus recognize the timing to exchange the toner cartridge over step by step, which is easy and more convenient to the user.

In FIG. 10, the broken line R denotes the level at the near-end value, the chain line S denotes the level at the end value, and the solid line T denotes the level at the end-end value. The cumulative count is set to numerical values of the maximum value A3, the near-end value A2 and the end value A1. Meanwhile, the driving time of the developer is set to numerical values of the maximum value B3, the end value B2 and the near-end value B1.

The cumulative count is determined from the number of recording papers (sheets) on which images are formed and a ratio of the area size of a toner-adhering portion to the size of one sheet (image occupancy rate). That is, the cumulative count changes depending upon the amount of images formed on sheets. In FIG. 10, the symbol U denotes a characteristic which uses an image occupancy rate of 1%, the symbol V denotes a characteristic which uses an image occupancy rate of 5%, and the symbol W denotes a characteristic which uses an image occupancy rate of 20%. The characteristic U is for forming images on four A4-sheets per job, and the characteristics V and W are for forming images on one A4-sheet per job. From FIG. 10, it is understood that there is a tendency that the higher the image occupancy rate becomes, the higher the cumulative count becomes and therefore the smaller the remaining toner amount becomes.

In the example shown in FIG. 10, the near-end value A2 is reached over 6,400 sheets (Ua) when the characteristic is the characteristic U which uses the image occupancy rate of 1%, over 4,800 sheets (Va) when the characteristic is the characteristic V which uses the image occupancy rate of 5%, but over 1,200 sheets (Wa) when the characteristic is the characteristic W which uses the image occupancy rate of 20%. Meanwhile, the end value A1 is reached over 8,000 sheets (Ub) when the characteristic is the characteristic U which uses the image occupancy rate of 1%, over 6,000 sheets (Vb) when the characteristic is the characteristic V which uses the image occupancy rate of 5%, but over 1,500 sheets (Wb) when the characteristic is the characteristic W which uses the image occupancy rate of 20%. The end-end value A3 is reached over 9,090 sheets (Uc) when the characteristic is the characteristic U, over 6,800 sheets (Vc) when the characteristic is the characteristic V, but over 1,700 sheets (Wc) when the characteristic is the characteristic W.

As for the characteristic U which uses the image occupancy rate of 1%, there is a difference of 20%, i.e., a difference between the near-end value A2 reached over 6,400 sheets (Ua) and the end value A1 reached over 8,000 sheets (Ub) in the example shown in FIG. 10. Between the end value A1 and the end-end value, there is a difference of 1,090 sheets which is a difference between 8,000 sheets (Ub) and 9,090 sheets (Uc). As for the characteristic V which uses the image occupancy rate of 5%, the near-end value A2 and the end value A1 are apart by 20%, i.e., a difference between 4,800 sheets (Va) and 6,000 sheets (Vb). Meanwhile, between the end value A1 and the end-end value, there is a difference of 800 sheets which is a difference between 6,000 sheets (Vb) and 6,800 sheets (Vc).

For each one of the characteristics U, V and W mentioned above, the maximum value (end-end value) B3, end value B2 and near-end value B1 of the driving time of the developer roller are set. For instance, the end-end value B3 for the characteristic U is 12,000 seconds. In light of the end-end value, appropriate near-end value and end value are set for each one of the characteristics U, V and W. With respect to the judgment of the life of the toner cartridge based on the driving time of the developer roller, a tendency that the life becomes shorter as the image occupancy rate is smaller on a sheet is thus recognized. In other words, for the same image occupancy rate, the cumulative count and the driving time of the developer roller have contradictory characteristics as for the life of the toner cartridge.

As described above, the life of the toner cartridge is determined based on whether either the cumulative count or the driving time of the developer roller has reached the predetermined level. In this embodiment, the life of the toner cartridge is managed with reference to the cumulative count of the toner consumption. The management of the life of the toner cartridge will now be described.

Figure 11:
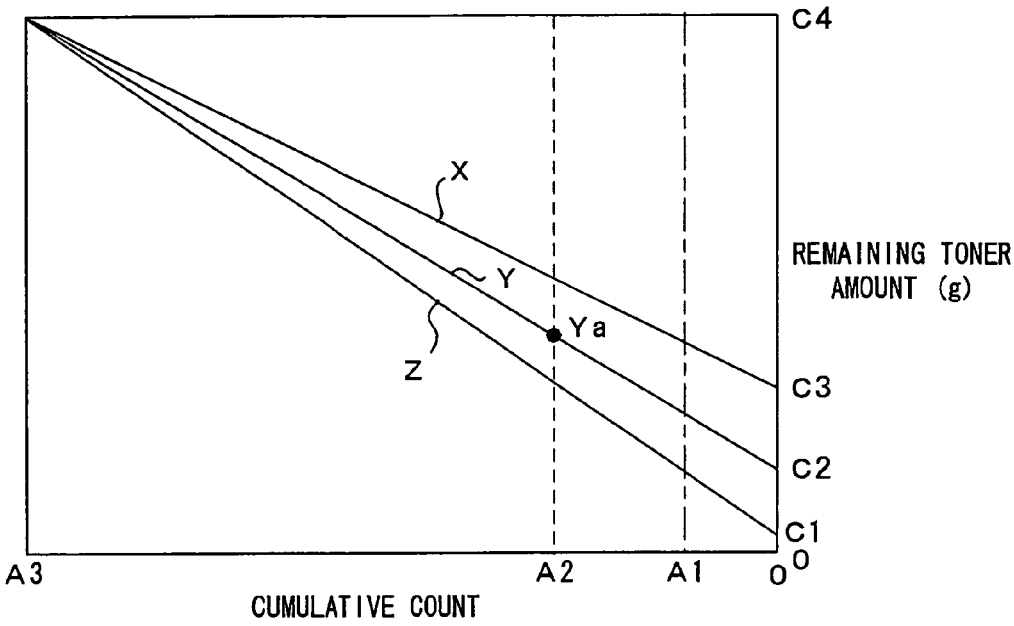
FIG. 11 is a characteristic diagram which shows a relationship between the cumulative count and the remaining toner amount.

FIG. 11 is a characteristic diagram which shows a relationship between the cumulative count and the remaining toner amount. The horizontal axis denotes the cumulative count, while the vertical axis denotes the remaining toner amount (g). In this case as well, the characteristic is different between the large-capacity cartridge and the small-capacity cartridge described above. FIG. 11 shows the characteristic of the large-capacity cartridge for instance, in relation to an example that an image is formed at the image occupancy rate of 5% on a sheet of the A4-size.

In the example shown in FIG. 11, a standard value and numerical values of ±12.5% of the standard value are set as toner end values respectively. A characteristic Y represents the remaining toner amount which is at the standard value, a characteristic X represents the remaining toner amount which is +12.5% of the standard value, and a characteristic Z represents the remaining toner amount which is −12.5% of the standard value. In FIG. 11, an initial value C4 of the toner amount is 225 g, for instance. Meanwhile, the standard end value C2 of the remaining toner amount is 54 g, the end value C3 for the characteristic X is 79 g, and the end value C1 for the characteristic Z is 30 g.

Along the horizontal axis, an initial value (maximum value) A3, a near-end value A2 and an end value A1 similar to those shown in FIG. 10 are set. A near-end value Ya for the standard characteristic Y is 83 g in this example. In this embodiment, the cumulative count which is used to judge the near-end amount representing the remaining toner amount is set in accordance with the actual condition of image formation for each color. At this stage, between the toner cartridge which has the large capacity and the toner cartridge which has the small capacity, the near-end value of the remaining toner amount is set to different values for the same color.

Figure 12A:
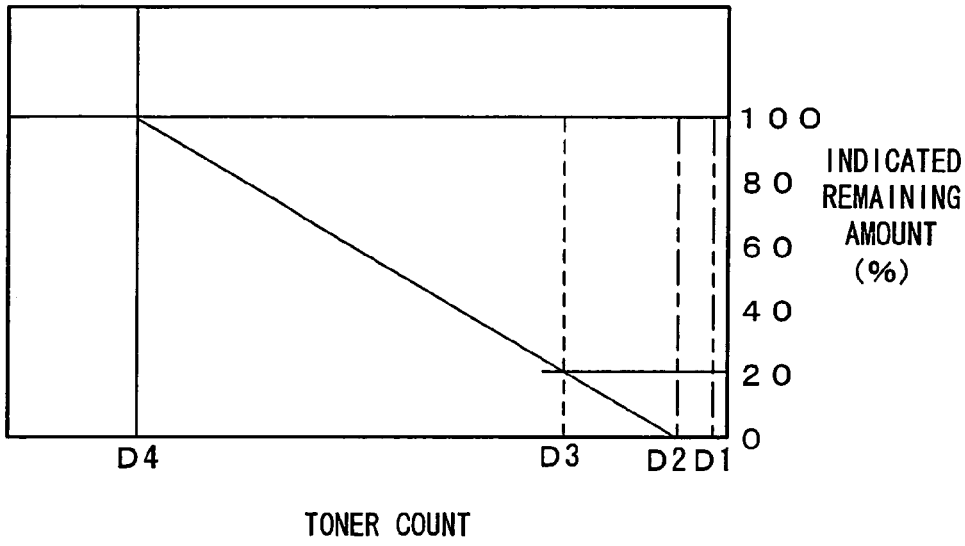
FIGS. 12A and 12B are explanatory diagrams which show the principle of managing the life of the toner cartridge in the first embodiment.
Figure 12B:
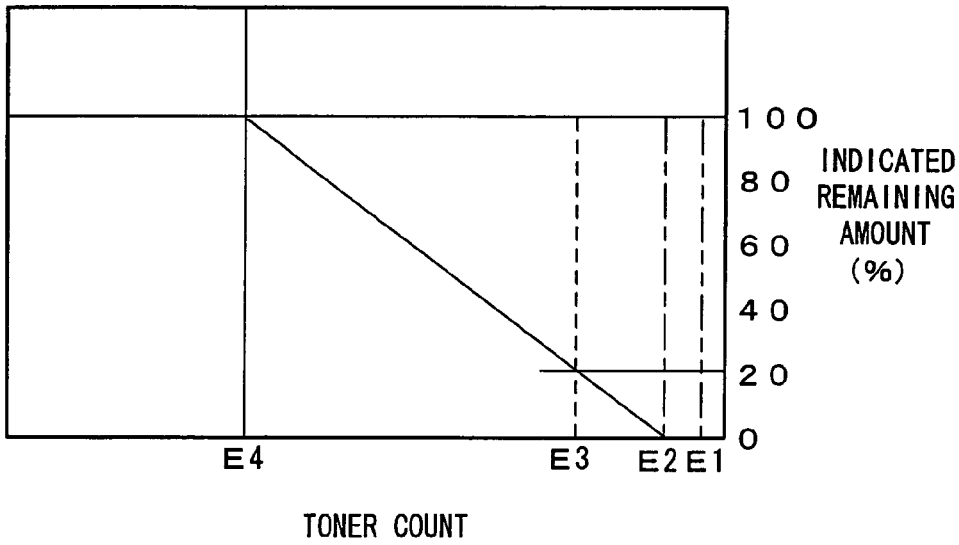

FIGS. 12A and 12B are explanatory diagrams which show the principle of managing the life of the toner cartridge in this embodiment. In these drawings, the horizontal axis denotes the cumulative count (toner count) and the vertical axis denotes the remaining toner amount (%). FIG. 12A corresponds to the large-capacity cartridge, while FIG. 12B corresponds to the small-capacity cartridge. In FIG. 12A, denoted at D4 is the maximum value (initial value) of the toner count, in which case the remaining toner amount is indicated as 100%.

Denoted at D3 is the near-end value of the toner count, denoted at D2 is the end value of the toner count, and denoted at D1 is the end-end value of the toner count. In the example shown in FIG. 12A, the near-end value D3 is indicated as 20% of the remaining toner amount. In this embodiment, the remaining toner amount resulting from consumption of toner is expressed as a proportion (%) relative to the initial value (100%), instead of absolute values (analog figures).

In the example shown in FIG. 12B, denoted at E4 is the initial value of the toner count, denoted at E3 is the near-end value of the toner count, denoted at E2 is the end value of the toner count, and denoted at E1 is the end-end value of the toner count. In the example shown in FIG. 12B as well, the near-end value E3 of the toner count is indicated as 20% of the remaining toner amount. In other words, in this embodiment, when the large-capacity cartridge is used and also when the small-capacity cartridge is used, the remaining toner amount is indicated on the same scale.

Hence, in an image forming apparatus which uses toner cartridges which have different toner capacities, the structure of a remaining toner amount indicator mechanism may be simple. In addition, since it is not necessary to execute separate calculations for the different toner cartridges having the different toner capacities in order to indicate the remaining toner amount, the calculations are simple. Further, the convenience for a user is better since there is no risk that the user will wrongly read the remaining toner amounts in the toner cartridges which have the different toner capacities.

By the way, during detection of print dots, at a position where the arrangement pattern of a print dot string changes, e.g., a position at which there is a change from an isolated dot to a continuous dot, the count accuracy of the toner counter deteriorates and the toner counter may sometimes fail to detect dots. Meanwhile, during image processing which uses the screen having the halftone dot structure mentioned above, the gaps between the pixels M which are linked by the inclined lines Ls may be set narrow in some cases. When this occurs, the pixels overlap with each other, and therefore, dot detection may fail while the toner counter scans the pixels in the main scanning direction and counts a toner consumption. Owing to this, the cumulative count may contain an error.

Noting this, according to the present invention, when the read accuracy of the toner counter deteriorates, the cumulative count of toner consumptions is corrected by means of data which are used during patch image control. Patch image control will now be described. In an image forming apparatus of the type which overlays toner images of the plurality of colors on the image carrier, since a potential in the exposed portion changes at the next step as the amount of toner transferred onto the image carrier changes, stricter control becomes necessary.

Further, an image density may vary because of fatigue or a change with time of the photosensitive member and toner, a change in environment surrounding the apparatus such as a temperature and humidity, etc. Such a technique has been proposed which is for appropriately adjusting a density control factor which influences the image density of a toner image, such as a charging bias, a developing bias and an exposure amount, and accordingly stabilizing the image density.

According to this technique, a patch image which is a toner image is formed on an image carrier for instance, a sensor optically measures the density of the toner image, and an operation of supplying toner to a developer or an operation of consuming toner inside the developer is controlled based on the detected density. To form a solid patch image and a thin line patch as patch images for density adjustment is known. A thin line patch is formed in the so-called "1-on-and-10-off" style for instance which is to form one dot line of image and not to form ten lines of image in the sub scanning direction.

The image forming apparatus 1 comprises a main controller 11 which includes an image memory 113 which stores image data transmitted from an external computer, as shown in FIG. 2. An engine controller 10 is also disposed which controls an engine part EG based on a signal received from the main controller 11. The solid patch image above is formed in a patch forming module of the engine controller 10. In short, it is the engine controller 10 that decides the density pattern of an image.

Figure 13:
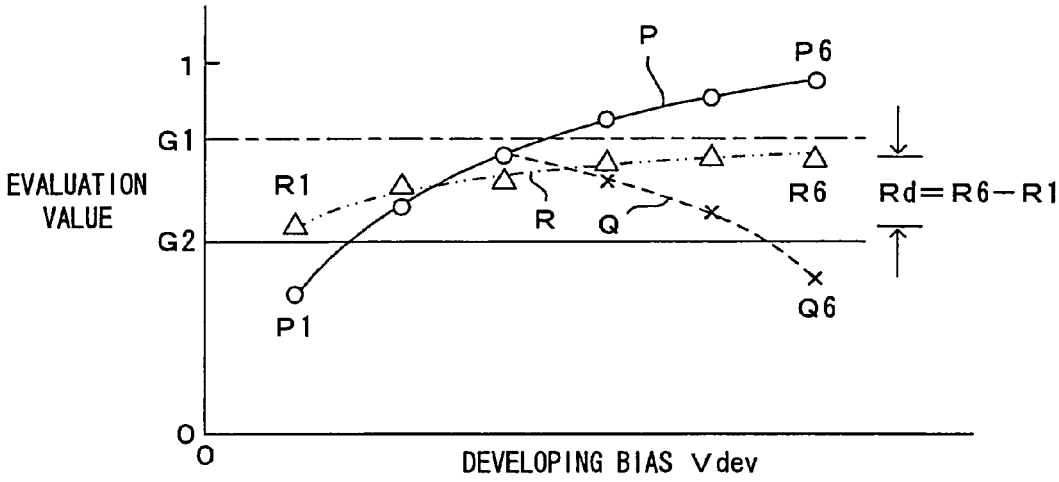
FIG. 13 is a characteristic diagram which shows an example of a patch image control.

FIG. 13 is a characteristic diagram which shows an example of a patch image control. In FIG. 13, the horizontal axis denotes a developing bias Vdev. The vertical axis denotes the evaluation value of a patch image density. As for the evaluation value, when a patch image density detected by the sensor, after converted into a numerical value from 0 to 1, is at or above a predetermined level G1, it is determined that the patch image has been formed normally. In other words, as the developing bias grows gradually, the evaluation value of a patch image density detected by the sensor as well usually increases as denoted at a characteristic P. At or above a certain developing bias, the predetermined level G1 is surpassed.

In contrast, when the remaining toner amount is small, the evaluation value of the patch image density starts decreasing at a certain level even though the developing bias is increased as denoted at a characteristic Q. There are some other instances that the evaluation value of the patch image density increases only moderately and will not exceed the predetermined level G1 even though the developing bias is increased as denoted at a characteristic R.

This embodiment notes that when the remaining toner amount is small as shown in FIG. 13, the evaluation value of the patch image density will not exhibit a normal characteristic even though the developing bias is increased. That is, which one of the evaluation value Q6 and a threshold value G2 for the patch number corresponding to a certain developing bias, which is the patch number 6 in this example, is larger than the other is determined, denoted at the characteristic Q. The patch number 6 represents the last one of the patch images which are formed over a predetermined of times. When the evaluation value Q6 is smaller than the threshold value G2, the cumulative count of the toner consumption is corrected on the assumption that the remaining toner amount is actually small, even though the cumulative count is equal to or larger than a certain value.

In this manner, during correction of the cumulative count of toner consumption based on data acquired through the patch image control, the cumulative count of the toner consumption is corrected using the patch image which corresponds to a large developing bias. Since a growth of a developing bias generally increases the density of a patch image, data which are supposed to have the highest density are used. In short, highly accurate data acquired through the patch image control can be used.

Further, also using the data acquired through the patch image control which will be needed for printing on a recording medium, the cumulative count of the toner consumption is corrected. This means omission of collection of dedicated data which are for correction of the cumulative count of the toner consumption, which simplifies the structure of a control part. Moreover, since the patch image data are not data which are acquired specially for the purpose of correcting the cumulative count of the toner consumption, it is possible to save the memory resource for data storage.

The threshold value G2 referred to in the context above is a numerical value which is set depending upon the remaining toner amount, and therefore, set as the threshold value G2 is a numerical value at such a level which permits image formation without a trouble regarding a recording medium. The threshold value G2 becomes large when the remaining toner amount is large, whereas the threshold value G2 becomes small when the remaining toner amount is small. Meanwhile, the cumulative count to be corrected is an end value which is a numerical value which is for providing a message which encourages to exchange a toner cartridge as described later.

As processing to handle a situation that the evaluation value of the patch image density is as denoted at the characteristic R, a difference is calculated between the evaluation value R6 for the patch number 6, which is the last one of the patch images which are formed over the predetermined of times, and the evaluation value R1 for the patch number 1. Even when the difference of the two, i.e., Rd=R6–R1 is smaller than the predetermined value, the cumulative count of the toner consumption is compensated for on the assumption that the remaining toner amount is actually small, even though the cumulative count is equal to or larger than the certain value.

This serves to handle a density difference between the last one and the first one of the patch images which are formed over the predetermined of times while increasing the developing bias. The cumulative count of the toner consumption is therefore corrected using the density difference between the patch image which corresponds to a large developing bias and the patch image which corresponds to a small developing bias. It is thus possible to deal with a small density difference between these two patch images.

Figure 14:
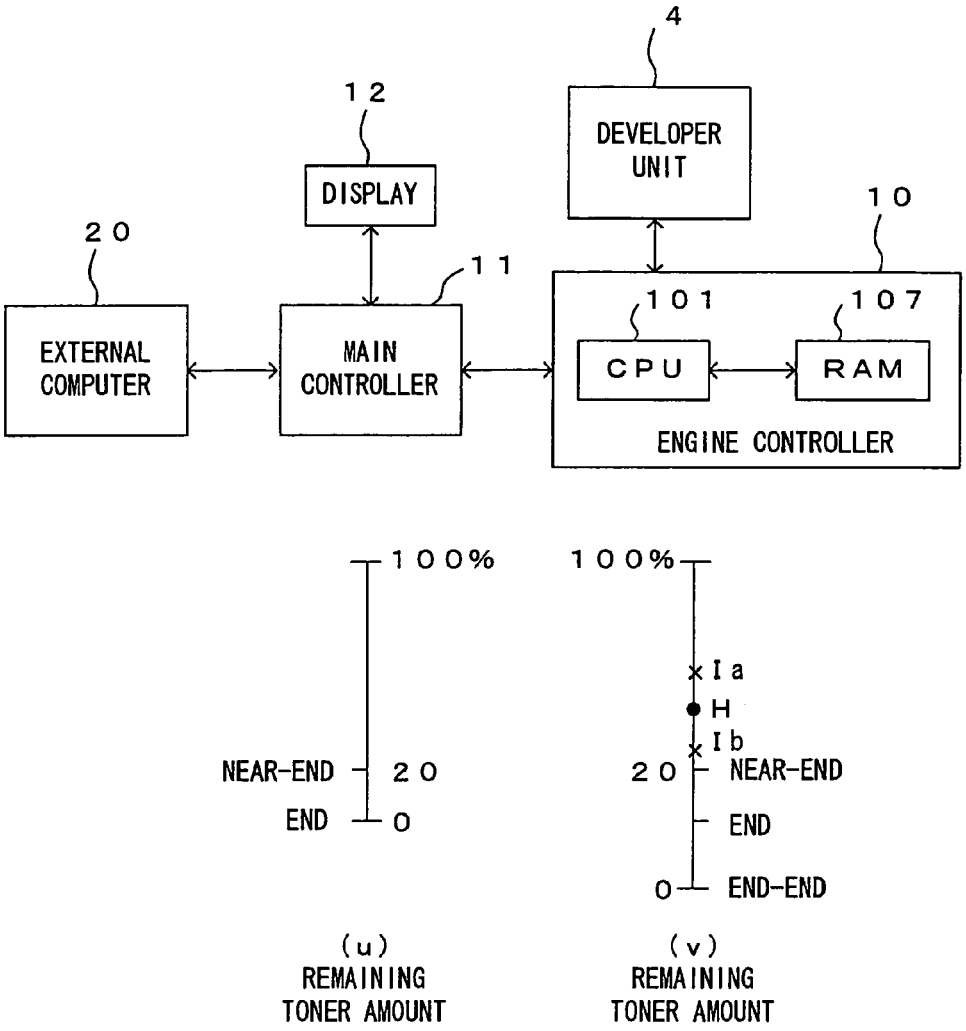
FIG. 14 is an explanatory diagram which shows the management of the life of the toner cartridge according to the first embodiment.

FIG. 14 is an explanatory diagram which shows the management of the life of the toner cartridge according to this embodiment. In FIG. 14, denoted at 20 is an external computer (host computer) which sends image data to the main controller 11. The display 12 is connected to the main controller 11, and the display 12 shows various types of messages and displays the remaining toner amount as % (proportion) to the initial value as described earlier with reference to FIGS. 12A and 12B.

The memory 91 and the like are disposed to the developer 4Y and the like of the developer unit 4. Stored in this memory are the initial value of the cumulative count of the toner consumption and the current remaining toner amount, each for the large-capacity toner cartridge and the small-capacity toner cartridge for each one of the colors.

A user may sometimes switches to the small-capacity cartridge and continues forming images after first using the large-capacity cartridge and forming an image on a recording medium, and then exchanges again the large-capacity cartridge for image formation. Even in such a case, the remaining toner amount corresponding to the large-capacity cartridge starts from where the previous value stood before the switching to the small-capacity cartridge. Hence, even when the toner cartridge has been replaced with the toner cartridge having the different toner capacity before reaching the end of its life, it is possible to precisely grasp the remaining toner amount. This realizes accurate management of the lives of the toner cartridges.

When the initial value of the cumulative count of the large-capacity cartridge is thirteen millions for instance, it is not thirteen millions that will be stored in the memory of the developer. To save the memory resource, a figure scaled down from thirteen millions, e.g., by dividing thirteen millions by an appropriate figure, is set as the initial value of the count.

The CPU 101 of the engine controller 10 calculates a toner consumption, subtracts this from the initial value and updates information regarding the current remaining toner amount. Thus updated information regarding the remaining toner amount is stored in the RAM 107 and also in the memory of the toner cartridge 4Y or the like. The remaining amounts information is updated separately for the respective colors, so that the RAM 107 and the memories of the toner cartridges always store the latest remaining toner amounts.

As an image signal is fed to the main controller 11 from the external computer 20, the CPU 111 executes predetermined signal processing on the image signal and outputs multi-tone scale signals corresponding to the respective colors (CMYK) to the engine controller 10. As described earlier, the engine controller 10 supplies the multi-tone scale signals to the exposure unit 6 and the toner counter 200.

The CPU 101 then subtracts the toner consumption calculated as the count registered in the toner counter 200 from the previous remaining toner amount, and makes the RAM 107 store the result. The remaining amount information is transmitted also to the main controller 11. When the near-end value described earlier is reached, the display shows a message which indicates that the timing to exchange the toner cartridge is coming soon.

A specific example of indication of the remaining toner amount in this embodiment will now be described. As described earlier, the CPU 101 of the engine controller 10 calculates the remaining toner amount from the count calculated in the toner counter. The CPU 101 hence holds information regarding a proportion ranging from the end-end value (0%) to the initial value (100%) as the remaining toner amount. The near-end value as described earlier with reference to FIGS. 12A and 12B is the proportion of 20% for example.

The end value is set between the near-end value and the end-end value. As described earlier, the engine controller 10 sends the information regarding the remaining amount to the main controller 11. The display 12 indicates the remaining toner amount based on this information. At this stage, the display 12 indicates the remaining toner amount as the proportion (%) to the initial value of 100%, on the basis that the end value is 0%.

That is, the information (v) shown in FIG. 14 regarding the remaining toner amount within the engine controller 10 is on the basis that the end-end value is 0% relative to the initial value. In contrast, within the main controller 11, the information (u) shown in FIG. 14 regarding the remaining toner amount is on the basis that the end value is 0%. As the remaining toner amount reaches the end value, the display shows a message which reads, "Please exchange the toner cartridge." This message does not change even after the remaining toner amount has reached the end-end value.

When notified of that the remaining toner amount has reached the end value, a user can understand that this toner cartridge needs be exchanged. Since indication referring to the end-end value, which corresponds to a smaller remaining toner amount than the end value, would not therefore be needed, this indication is in line with the actual situation. If the fact that the remaining toner amount is smaller than the end value is displayed, the user would rather continue forming an image in some cases. This creates a problem that an image formed on a recording medium will become blurred and the quality will thus deteriorate.

As the RAM 107 stores the new remaining toner amount in this fashion, the CPU 101 compares the updated remaining toner amount with the near-end value, and when the remaining toner amount has already reached the near-end value, outputs a signal which addresses that the toner cartridge is coming to the end of its life. In other words, the CPU 101 functions as judging means which judges the timing to exchange the toner cartridge.

An example of correcting the cumulative count of the toner consumption using the evaluation value of the patch image density detected by the sensor as in FIG. 13 will now be described. This embodiment demands to first determine whether the cumulative count (numerical value) is equal to or larger than H which denotes half the amount between the initial value and the end value. When the count (numerical value) is equal to or larger than H, the cumulative count is not corrected.

In the example shown in FIG. 14, when the cumulative count is Ia for instance, the remaining toner amount is sufficient. A user does not have to consider immediately exchanging the toner cartridge even when the count accuracy of the toner counter has deteriorated, and hence, the count is not corrected. This is processing in line with the reality that there is no problem when the remaining toner amount is between the initial value and the half the amount and therefore large. It is therefore possible to simplify the structure of the control part which is for correction of the cumulative count of the toner consumption.

On the other hand, when the cumulative count is at or below H which denotes half the amount, e.g., Ib in the example shown in FIG. 14, even though Ib is equal to or larger than the near-end value, it is possible that the actual remaining toner amount has become smaller than the near-end value. In such a case, the display 12 does not show the message which warns about the small remaining toner amount. Hence, if the user still keeps printing, the image will become blurred and the quality will deteriorate.

Noting this, the cumulative count is at or below H which denotes half the amount, however the numerical value Ib is, the cumulative count of the toner counter is forcedly set to the end value. The display 12 therefore shows such a message as the one which reads, "Please exchange the toner cartridge," thereby encouraging the user to exchange the toner cartridge. Further, since each printing on a recording medium requires a user instruction, the user can print while confirming the printing quality sheet by sheet, which prevents deterioration of the printing quality.

The cumulative count of the toner consumption to be corrected thus corresponds to the numerical value representing the end value upon which the message encouraging exchange of the toner cartridge, as described above. For this reason, when the user prints on a recording medium, the user can be prepared for such a situation that the image becomes blurred or the printing quality otherwise deteriorates during the job.

Figure 15:
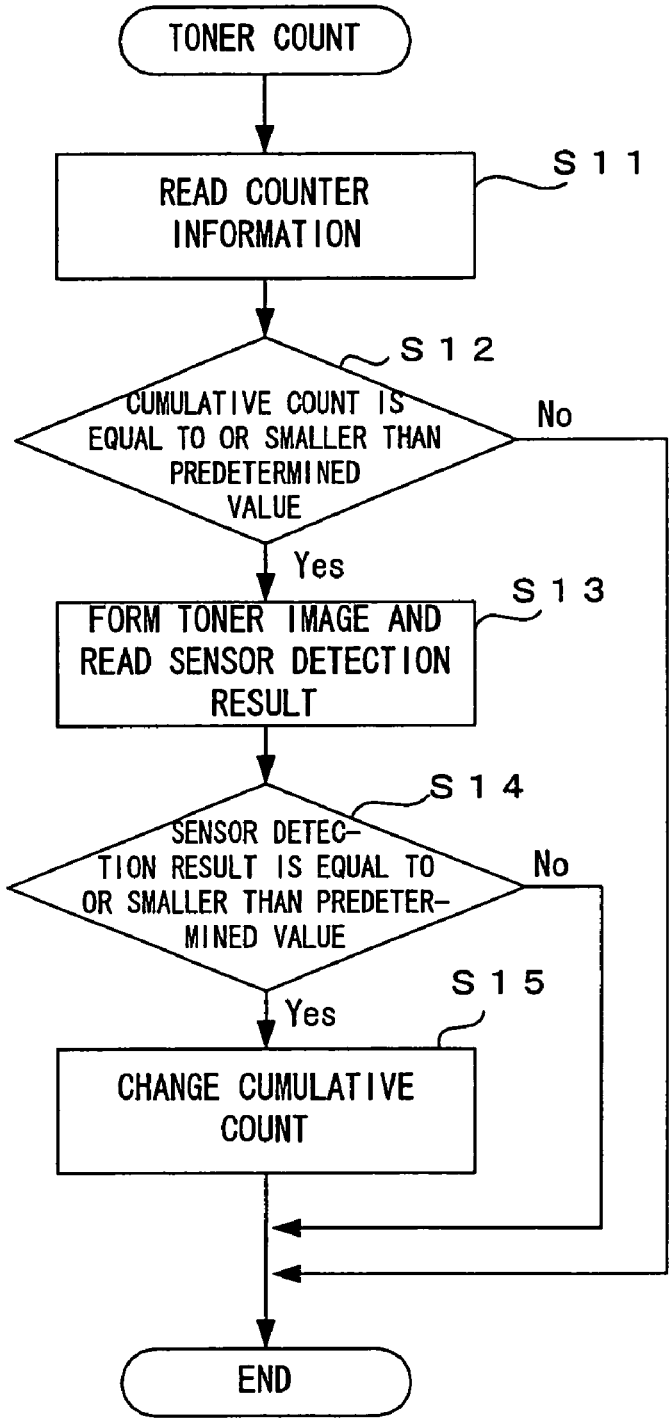
FIGS. 15 and 16 are flow charts which show an example of a processing sequence in the first embodiment.
Figure 16:
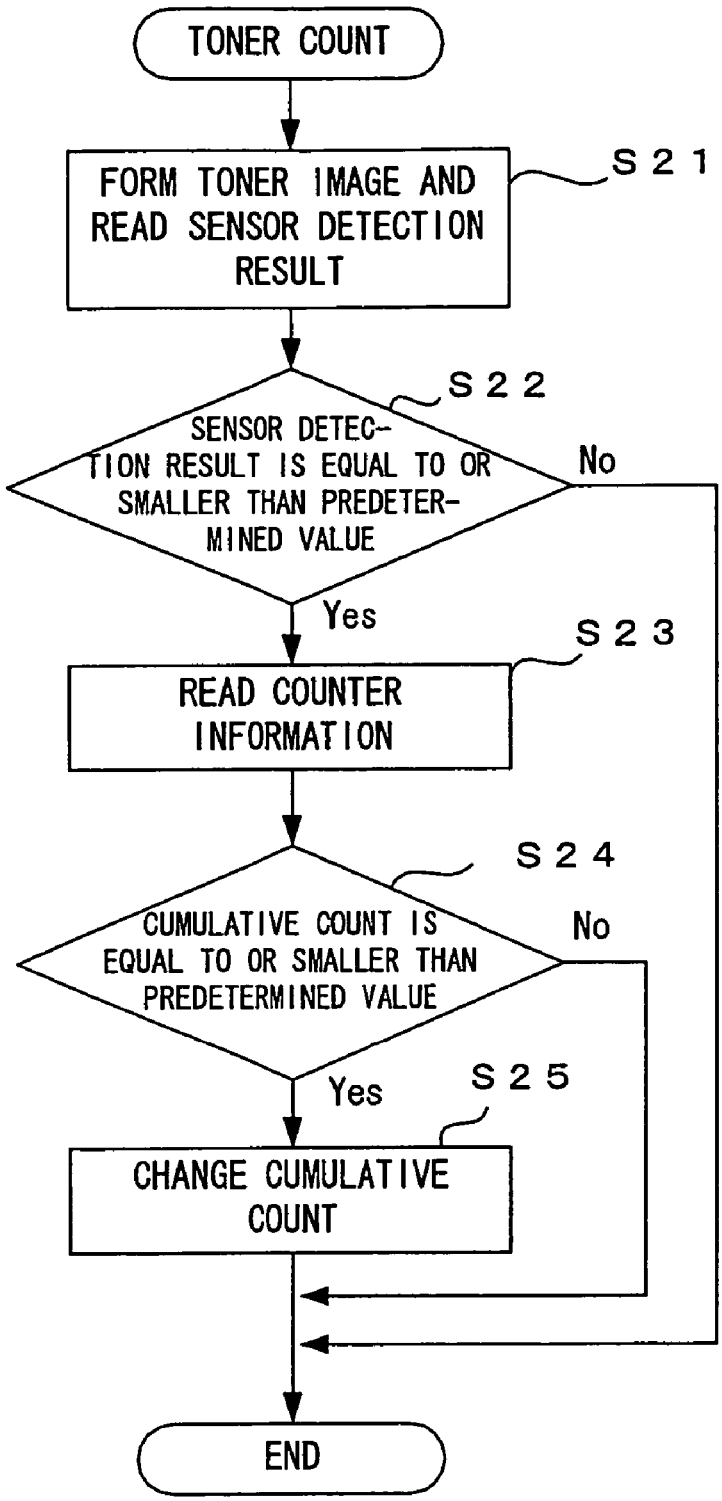

FIGS. 15 and 16 are flow charts which show an example of a processing sequence in this embodiment. These flow charts will now be described. In FIG. 15, a program for toner count processing is started. Counter information is then read (Step S11), and whether the cumulative count is equal to or larger than a predetermined value (a first predetermined value), e.g., whether the numerical count is equal to or larger than half the amount between the initial value and the end value, is judged (Step S12). When the result of the judgment is No, the processing program is terminated.

When the cumulative count is equal to or smaller than the predetermined value, the result of the judgment (Step S12) is Yes, in which case toner image formation is continued and the result of detection executed by the patch image sensor is read (Step S13). Following this, whether the sensor detection result is equal to or smaller than a predetermined value (a second predetermined value which is a threshold value set in accordance with the remaining toner amount) is judged (Step S14). When the result of the judgment is No, the processing program is terminated.

On the contrary, when the result of the judgment (Step S14) is Yes, the cumulative count is changed (Step S15). In other words, when the evaluation value of the patch image density shown in FIG. 13 is expressed as the characteristic Q or the characteristic R and when the cumulative count is Ib shown in FIG. 14, the cumulative count is forcedly set to the end value for example.

The flow chart in FIG. 16 will now be described. A program for toner count processing is started. Toner image formation is then continued and the result of detection executed by the patch image sensor is read (Step S21). Following this, whether this sensor detection result is equal to or smaller than a predetermined value (a threshold value) is judged (Step S22). When the result of the judgment is No, the processing program is terminated.

On the contrary, when the result of the judgment (Step S22) is Yes, counter information is read (Step S23), and whether the cumulative count is equal to or smaller than a predetermined value, e.g., half the amount between the initial value and the end value is judged (Step S24). When the result of the judgment is No, the processing program is terminated. When the cumulative count is equal to or smaller than the predetermined value, the result of the judgment (Step S24) is Yes, in which case the cumulative count is changed (Step S25).

In the example shown in FIG. 15, the information of the toner consumption is acquired first, and whether to correct the count using the patch control information is then judged based on the result of this. In contrast, in the example shown in FIG. 16, the patch control information is acquired first, and whether to correct the count using the information of the toner consumption is then judged based on the result of this.

In other words, in the example shown in FIG. 15, when the cumulative count is equal to or larger than the predetermined value, e.g., half the amount between the initial value and the end value, the subsequent processing is omitted and correction of the count based on the patch control information is not executed. In the example shown in FIG. 15, when the cumulative count of the toner consumption is not equal to or smaller than the first predetermined value, it is automatically determined no to correct the cumulative count of the toner consumption without using the data resulting from the patch image control. This achieves speedy execution of the processing.

In the example shown in FIG. 16, when the result of the detection executed by the patch image sensor is equal to or larger than the predetermined value (the threshold value), the processing triggered by reading of the subsequent count is omitted and correction of the count is not executed. When the data resulting from the patch image control are not equal to or smaller than the second predetermined value, it is thus automatically determined not to correct the cumulative count of the toner consumption without judging whether the cumulative count of the toner consumption is equal to or smaller than the first predetermined value. This achieves speedy execution of the processing. Any one of the processing shown in FIGS. 15 and 16 can be readily implemented by means of a modification to the program.

The processing at Step S12 in FIG. 15 and that at Step S24 in FIG. 16 corresponds to first half of judging step of the present invention which judges whether the cumulative count of the toner consumption is equal to or smaller than the first predetermined value. The processing at Step S14 in FIG. 15 and that at Step S22 in FIG. 16 corresponds to second half of judging step of the present invention which judges whether the result of the detection executed by the patch image sensor is equal to or smaller than the second predetermined value. The processing at Step S15 in FIG. 15 and that at Step S25 in FIG. 16 of changing the cumulative count is executed by the CPU 101 of the engine controller, and this processing corresponds to correcting step of the present invention which corrects the cumulative count of the toner consumption.

As described above, in this embodiment, the engine part EG functions as "image forming device" of the present invention. Meanwhile, the engine controller 10, and particularly the CPU 101, functions as comprising "calculator", "judging device", "exchange judging device" and "controller" of the present invention. Hence, a combination of the CPU 101, the toner counter 200 and the sensor corresponds to "toner consumption calculating apparatus". The photosensitive member 22 functions as a "latent image carrier" of the present invention.

Second Embodiment

A second preferred embodiment of the image forming apparatus according to the present invention will now be described. This embodiment demands adjustment of an image forming condition given to each developer (toner cartridge) at predetermined timing, such as immediately after turning on of the power source of the apparatus and when a predetermined number of images have been just formed, to thereby stabilize the quality of images. To be specific, a toner image having a predetermined pattern is formed as a patch image, the sensor 60 detects the amount of toner which constitutes the patch image. Then, a developing bias, the intensity of an exposure beam L and the like which serve as control factors influencing the image quality are adjusted based on the result of the detection, and the operation conditions for the respective portions of the engine part EG during image formation are accordingly optimized.

When the image density of a patch image formed under a predetermined condition is outside an expected range, it is determined that the apparatus is in an abnormal state and predetermined error processing is executed. The reason why such an abnormal image density is detected may be a situation that the image density itself has become abnormal due to failure of the engine part EG or a situation that the detection result has become abnormal due to abnormality during the density detection such as an abnormal operation of the sensor 60 and admission of a noise. It is not possible to calculate optimal image forming conditions based on the detection result in any case.

It is desirable that the image forming conditions are controlled and abnormality is judged based on the image density of an actually formed patch image. However, direct measurement of the image density on the sheet S which is the final recording medium is not practical. This is because various types of sheets such as recording papers and transparent sheets can be used as the sheets S, the hues of the sheets S themselves are not therefore constant and it is difficult to precisely measure image densities, and because the sheets S are used for every control, which is remarkably uneconomic.

Noting this, this embodiment demands detection of the amount of toner on the intermediate transfer belt 71 which is the image carrier temporarily carrying the toner image as it is before transfer onto the sheet S, instead of measuring densities on the sheet S. This however gives rise to the following problem.

Figure 17A:
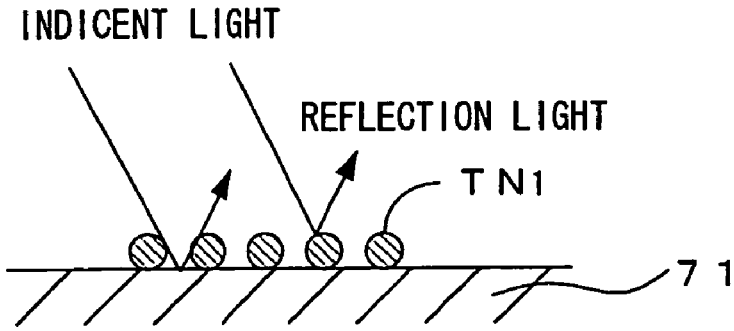
FIGS. 17A, 17B and 17C are drawings which show a relationship between an image density and the amount of toner which constitutes a toner image.
Figure 17B:
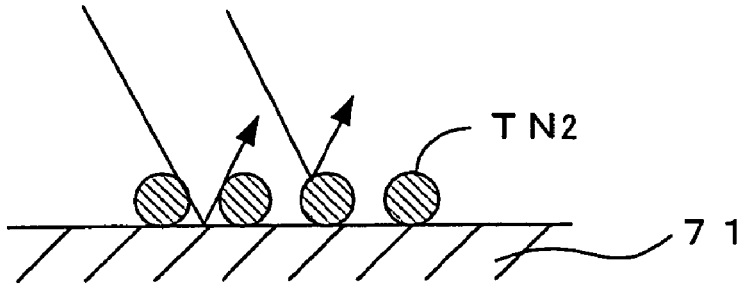
Figure 17C:
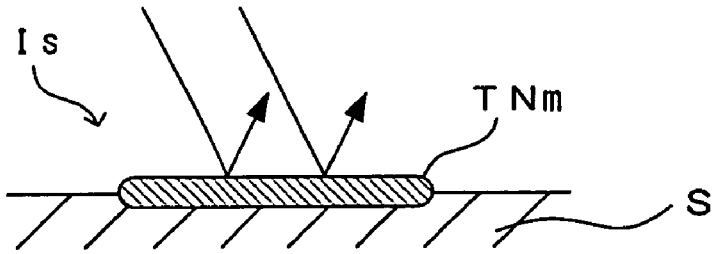

FIGS. 17A, 17B and 17C are drawings which show a relationship between an image density and the amount of toner which constitutes a toner image. The sensor 60 according to this apparatus irradiates a predetermined amount of light toward a toner image which is on the intermediate transfer belt 71 and serves as a patch image, detects the amount of reflection light and accordingly calculates the amount of toner which constitutes the toner image.

As shown in FIG. 17A, on the intermediate transfer belt 71 which is a temporary image carrier, particle-like toner TN1 adhering to the surface of the belt 71 due to static electricity forms a toner image. Consideration will now be given on an instance that the toner image is formed by the toner TN1 having relatively small particle diameters as shown in FIG. 17A and an instance that the toner image is formed by the toner TN2 having relatively large particle diameters as shown in FIG. 17B.

The amount of the reflection light from the toner image detected by the sensor 60 changes depending upon whether the amount of toner covering the surface of the intermediate transfer belt 71 is large or small. To be more specific, whether the amount of the reflection light is large or small is dependent upon the size of the area that the intermediate transfer belt 71 is covered with the toner. Hence, regardless of whether the toner constituting the toner image is the toner TN1 having the small particle diameters or the toner TN2 having the large particle diameters, as long as the toner covers approximately the same sizes of areas on the intermediate transfer belt 71, approximately the same toner amounts are detected.

Meanwhile, the image density of an image Is fixed on the sheet S is determined by the amount of toner TNm fused on the sheet S, and accordingly reflects the amount of toner (mass or volume) adhering per unit area size, as shown in FIG. 17C. Thus, even though toner amounts detected by the sensor 60 are the same, final image densities may not be the same when the particle diameters of toner constituting the toner images are different.

According to experiments conducted by the inventors of the present invention, as images are formed successively with a developer filled with toner, toner particles having relatively small particle diameters are selectively consumed while toner particles having relatively large particle diameters are not consumed very much at the initial stage. A particle diameter distribution of the toner within the developers gradually changes owing to this. In addition, when a toner amount detected by the sensor 60 remains the same, the larger the particle diameters of the toner constituting the toner images become, the higher the image densities on the sheets S become. In this apparatus therefore, the image densities corresponding to the same toner amount gradually increase as the amount of the toner remaining within the developer decreases.

Figure 18:
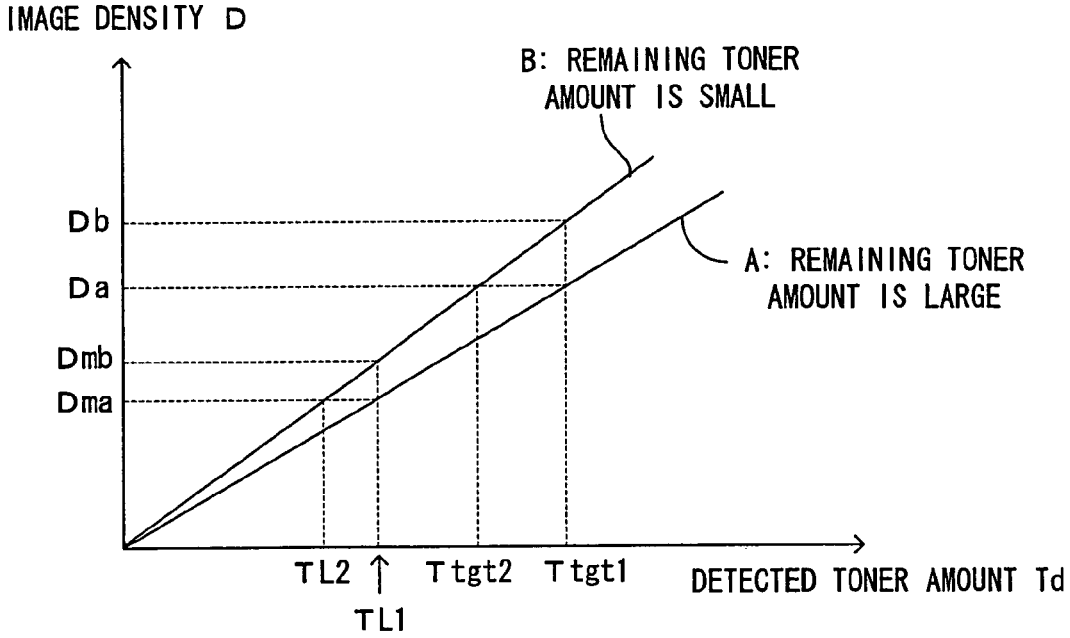
FIG. 18 is a drawing which shows a relationship between a detected toner amount value and an image density.

FIG. 18 is a drawing which shows a relationship between a detected toner amount value and an image density. While a detected toner amount value Td on the intermediate transfer belt 71 detected by the sensor 60 is assumed in an approximately linear relationship with an image density D on the sheet S, the gradient becomes different depending on the remaining toner amount within the developer. In other words, as shown in FIG. 18, a line B representing a later stage during which the remaining toner amount decreases and the proportion of toner having large particle diameters increases has a greater gradient than a line A representing an initial stage during which the remaining toner amount is relatively large.

Hence, even when the image forming conditions are controlled such that the detected toner amount value Td detected by the sensor 60 will always be a constant target value Ttgt1, the image density D on the sheet S fails to become constant but instead gradually changes from an initial density Da to a later density Db. In other words, making the target value Ttgt1 of the detected toner amount value Td constant does not make it possible to maintain the image density on the sheet S constant.

A similar problem arises during judgment of abnormality of the apparatus. Consideration will now be given on an instance that a lower limit value TL1 is determined in advance which represents a proper amount of toner constituting a patch image formed under predetermined image forming conditions and that abnormality is recognized when the actual detected toner amount value Td becomes smaller than the lower limit value TL1. This is on the assumption that the density of an image formed under certain image forming conditions will become abnormally low. Since such abnormality could lead to an extreme deterioration of the image quality such as a blurred image and an uneven density, it is not preferable to allow continued execution of the image forming operation in this condition.

As the lower limit value TL1 of a toner amount is defined in advance and abnormality is recognized when the detection value Td resulting from actual measurement becomes smaller than the lower limit value TL1, an extremely inferior image whose image density is lower than a predetermined density will not be formed. For instance, in the event that a large amount of toner still remains within the developer (as denoted at the line A in FIG. 18), abnormality may be recognized when the actual detected toner amount value Td becomes smaller than the lower limit value TL1, to thereby ensure that the image density D is equal to or larger than Dma. In the following, the minimum image density not recognized as abnormality will be hereinafter referred to as "minimum guaranteed density." In the example above, the minimum guaranteed density is Dma.

On the contrary, as the remaining toner amount decreases (as denoted at the line B in FIG. 18), the minimum guaranteed density becomes Dmb so long as the lower limit value is TL1. The image density Dmb is a value within an appropriate density range at the initial stage. Thus, making the lower limit value TL1 constant leads to an instance that abnormality is recognized and an instance that abnormality is not recognized even though the same image density is obtained, which is considerably detrimental to the stability of image densities.

It is particularly irrational for a user to see the minimum guaranteed density rising when the remaining toner amount is decreasing. The user would not accept that image formation at a certain density which has been proper and permitted initially will be regarded abnormal and prohibited later. Further, even if it is understandable to the user that the minimum guaranteed density will have to be lowered since image densities will unavoidably decrease as the toner runs low, the user would not see any necessity at all to increase the minimum guaranteed density. There is another user demand that the user wishes to keep forming images even when the toner is left only in a small amount, knowing that the image quality could deteriorate.

A solution of this problem which also meets the user demand may be to change a control target value which is for control of the image forming conditions and the lower limit value which is for abnormality judgment toward the lower toner amount side, i.e., from Ttgt1 to Ttgt2 and TL1 to TL2, in accordance with a decrease of the remaining toner amount as shown in FIG. 18. In this manner, regardless of whether the remaining toner amount is large or small, it is possible to maintain the image density Da and the minimum guaranteed density Dma constant and stabilize image densities.

Based on the above, in this embodiment, the CPU 101 executes the program stored in the ROM 106, the image forming conditions are controlled in the following manner. While optimization of the developing bias among control factors influencing the image quality will now be described, the other control factors such as the intensity of the exposure beam L and the charging bias can be optimized in a similar fashion.

Figure 19:
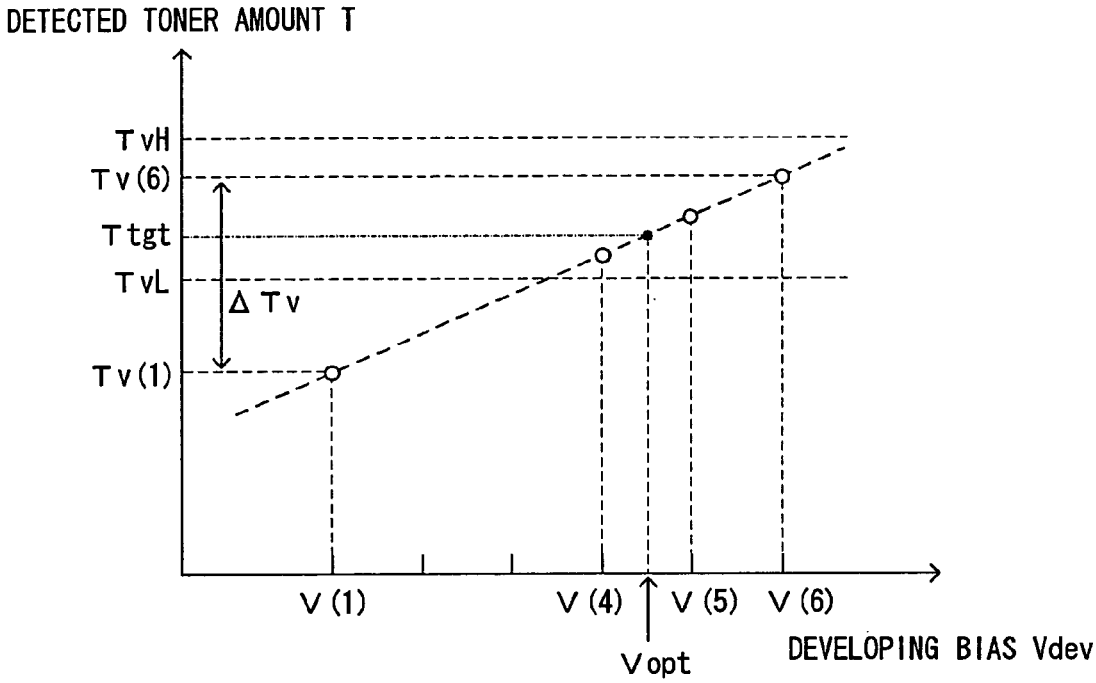
FIG. 19 is a drawing for describing the principle of bias adjustment.
Figure 20:
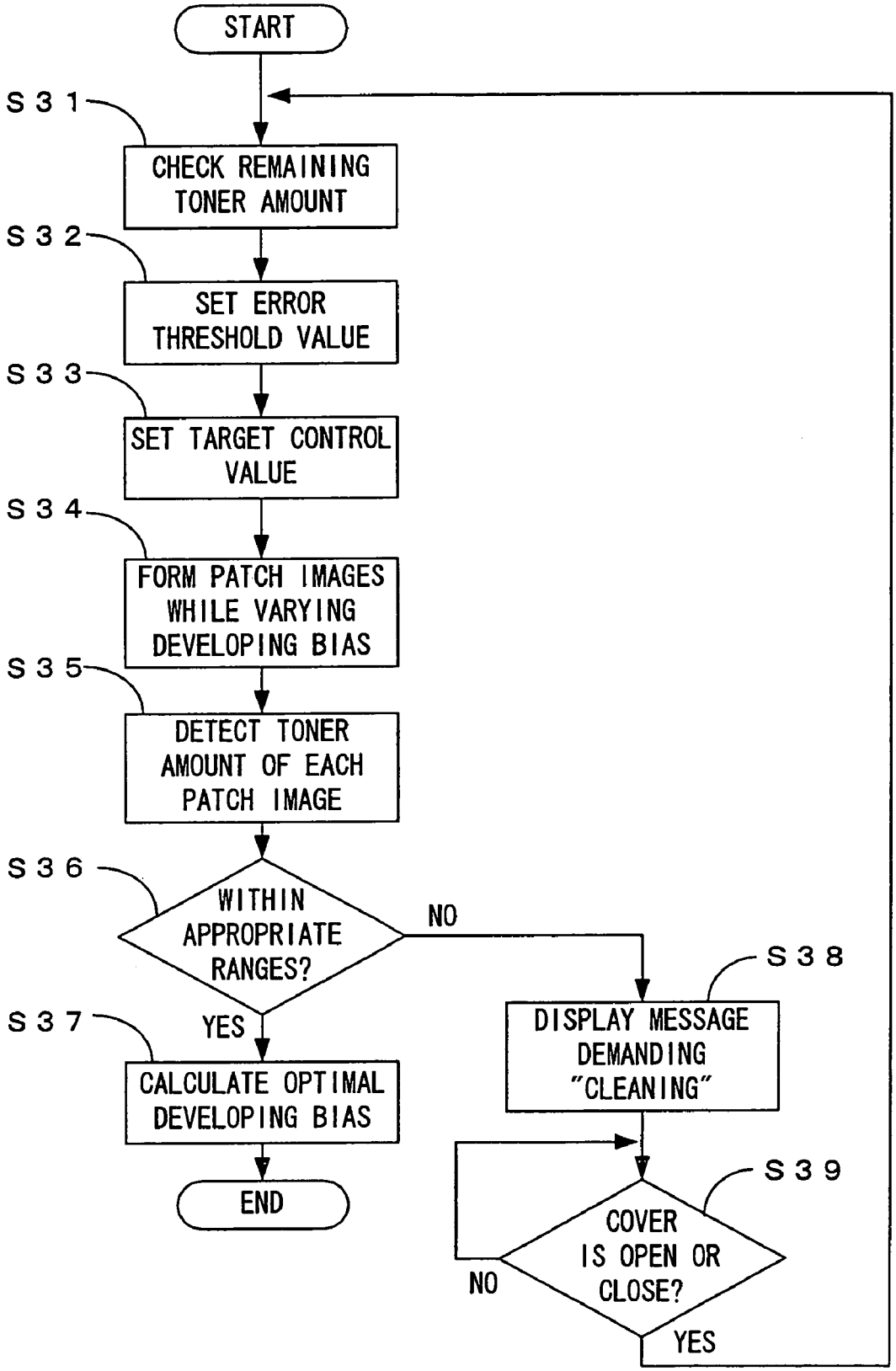
FIG. 20 is a flow chart of bias adjustment processing.

FIG. 19 is a drawing for describing the principle of bias adjustment. FIG. 20 is a flow chart of bias adjustment processing. Although the detected toner amount Td is adopted as the vertical axis in FIG. 19, the evaluation value described earlier can be adopted alternatively. While an image is being formed, the image density of the image changes as the developing bias Vdev applied upon the developer roller changes, and therefore, the detection value Td detected by the sensor 60 also changes as shown in FIG. 19. The following assumes that the larger the developing bias Vdev is, more the image density increases.

A target toner amount Ttgt corresponding to a target image density is determined, and an optimal value Vopt of the developing bias Vdev, which makes the detected toner amount value Td detected by the sensor 60 reach the target value Ttgt, is then calculated. Patch images (which may be solid images for instance) having the same pattern are formed at each level of the developing bias Vdev while varying the developing bias Vdev over multiple of levels, and the sensor 60 detects a toner amount each time, thereby identifying a relationship between the developing bias Vdev and the detected toner amount value Td as shown in FIG. 19. From thus identified relationship, the optimal value Vopt of the developing bias Vdev which makes the toner amount coinciding with the target value Ttgt can be calculated.

At this stage, it is clear that if the developing bias Vdev is graduated finely and the number of patch images to be formed is increased, the optimal value Vopt of the developing bias will be calculated at a high accuracy. However, as a great number of patch images are formed, the consumption of the toner increases and the processing time becomes longer. It is therefore necessary to determine the graduation of the developing bias Vdev and the number of patch images to be formed in accordance with the specifications of the apparatus, the demanded image quality, etc. In this embodiment, considering a balance between the variable range of the developing bias Vdev and the image quality, the number of patch images to be formed is six, that is, the developing bias is varied over six levels from V(1) to V(6). Further, the symbol Tv(n) denotes the detected toner amount value of a patch image which is formed while setting the developing bias Vdev to V(n) (where n=1, 2, . . . , 6).

The concrete content of the processing is as shown in FIG. 20. Although the optimization processing is executed for each one of the respective colors, an example on the yellow developer 4Y will now be described. First, the remaining toner amount of toner held within the yellow developer 4Y is checked (Step S31). The initial toner amount in the yellow developer 4Y is written in the built-in memory 91 in advance, but read by the CPU 101 and stored in the RAM 107 upon mounting of the developer 4Y to the apparatus. The CPU 101 can thus calculate the current remaining toner amount, from the initial toner amount and the amount of toner which is consumed as an image is formed.

Next, based on the remaining toner amount, an error threshold value and a control target value are determined (Step S32 and Step S33). The error threshold value is a value which corresponds to the lower limit value TL1 or TL2 shown in FIG. 18, and as such is a value which serves as a reference for judging whether the detected toner amount value of a patch image which will be formed later is appropriate or not.

In this embodiment, the error threshold value is determined as follows. First, an error threshold value TvH is determined as for the detected toner amount value Tv(1) of a patch image which is formed at the developing bias V(1), and it is decided that the detected value Tv(1) is proper when the detected value Tv(1) is equal to or smaller than the error threshold value TvH. But when the detected value Tv(1) is beyond the error threshold value TvH, it is decided that the detected value Tv(1) is abnormal. This is because the great excess of the detected toner amount value Tv(1) beyond the target value Ttgt is considered to have arisen from some abnormality, since the developing bias V(1) is a developing bias value which brings about the lowest image density.

The opposite possibility is that a patch image which is supposed to have the highest image density, namely, the patch image formed at the developing bias V(6) has too low a detected toner amount value Tv(6). Noting this, in this embodiment, an error threshold value TvL is set for the detected value Tv(6) and the detected value is determined abnormal when the detected value Tv(6) has failed to reach the value TvL.

An error threshold value ΔTm is set also for a difference between two detected toner amount values:

$$\Delta Tv = Tv(6) - Tv(1) \quad \text{(Eq. 4)}$$

The value ΔTv must be a positive value which is large to a certain extent or larger. This is because when the apparatus is working normal, the larger the developing bias Vdev is, the higher the image density must be and therefore Tv(6) must be a larger value than Tv(1). It is hence determined that the detected value is proper when the value ΔTv expressed by (Eq. 4) is equal to or larger than the error threshold value ΔTm, while when the value ΔTv is smaller than the value ΔTm, the detected value is abnormal.

Meanwhile, the control target value is a value which corresponds to the target value Ttgt1 or Ttgt2 shown in FIG. 18, and as such is a value which corresponds to the target image density. The control target value Ttgt is set in accordance with the remaining toner amount at the time. For instance, in the event that the target image density is the density Da shown in FIG. 18, the control target value is set to TL1 when the remaining toner amount has a value corresponding to the line A, but to TL2 when the remaining toner amount has a value corresponding to the line B. In this manner, it is possible to maintain image densities constant regardless of the remaining toner amount.

As the error threshold value and the control target value are thus determined, while varying the developing bias Vdev from the minimum value V(1) one level at time, a patch image is formed at each bias value (Step S34). The sensor 60 detects the toner amount on each patch image (Step S35).

Among the patch images on which the toner amounts are thus detected, as for the two patch images formed at the minimum developing biases V(1) and V(6), the detection results Tv1, Tv6 and ΔTv are compared with the respective error threshold values mentioned above, and whether each value is within the appropriate range described above is judged (Step S36).

When the result is that the values Tv(1) and Tv(6) and ΔTv are respectively within the appropriate ranges, it is decided that the apparatus is normal, and the optimal developing bias Vopt is then calculated (Step S37). In the example shown in FIG. 19, the optimal developing bias Vopt corresponding to the toner amount Ttgt which achieves the target density is between the two developing biases V(4) and V(5), and hence, the optimal developing bias Vopt can be calculated as a bias value which is at the intersection between the broken line connecting the two and the chain line representing the target toner amount Ttgt.

The RAM 107 stores thus calculated optimal developing bias Vopt, and during the later image formation, the developing bias Vdev applied upon the developer roller is set to this optimal value Vopt, thereby attaining the target image density in a stable manner.

On the contrary, at Step S36, when at least one of the values Tv(1) and Tv(6) and ΔTv is not within the appropriate ranges described above, it is decided that the apparatus is an abnormal state, and predetermined error processing is executed. This error processing may have any desired content. In this example, the display 12 shows a message encouraging a user to clean the sensor 60 (Step S38). This is because adhesion of toner to the sensor 60 may result in an abnormal detected toner amount value in some cases and because cleaning of the sensor 60 often obviates such abnormality.

While it is difficult to judge whether cleaning by a user has taken place, when a cover (not shown) covering the engine part EG for instance has been opened once and then closed again, presumption of some work done by the user is plausible. In addition, when the sensor 60 has been cleaned, the image forming conditions need be adjusted again.

In this embodiment, after waiting until the user has opened or closed the cover (Step S39), the processing which starts at Step S31 is repeated again. This makes it possible to optimize the developing bias Vdev when cleaning of the sensor 60 has already resolved the abnormality, while in the event that the abnormality has not been resolved, it is decided again that abnormality still exists. Hence, it is desirable that an operation manual or the like clearly describes that when the same message appears once again even though the user has cleaned the sensor 60 in accordance with the message demanding cleaning of the sensor 60, severer abnormality could have occurred and the user should therefore request for repair work provided by a professional service person.

FIG. 21 is a drawing of an example of the error threshold value and the control target value. An instance that the error threshold value and the control target value are set at two levels depending upon the remaining toner amount will now be described for the simplicity of description. However, the error threshold value and the control target value may be at three or more levels or varied continuously depending upon the remaining toner amount.

The developers used in this example are each capable of holding maximum 230 g of toner, and the error threshold value and the control target value are varied depending upon whether the remaining toner amount exceeds 30 g or less than 30 g. The numerical values representing the toner amount are normalized values such that 0 represents no adhesion of toner at all and 1 represents such a toner amount which achieves the maximum image density.

Figure 22:
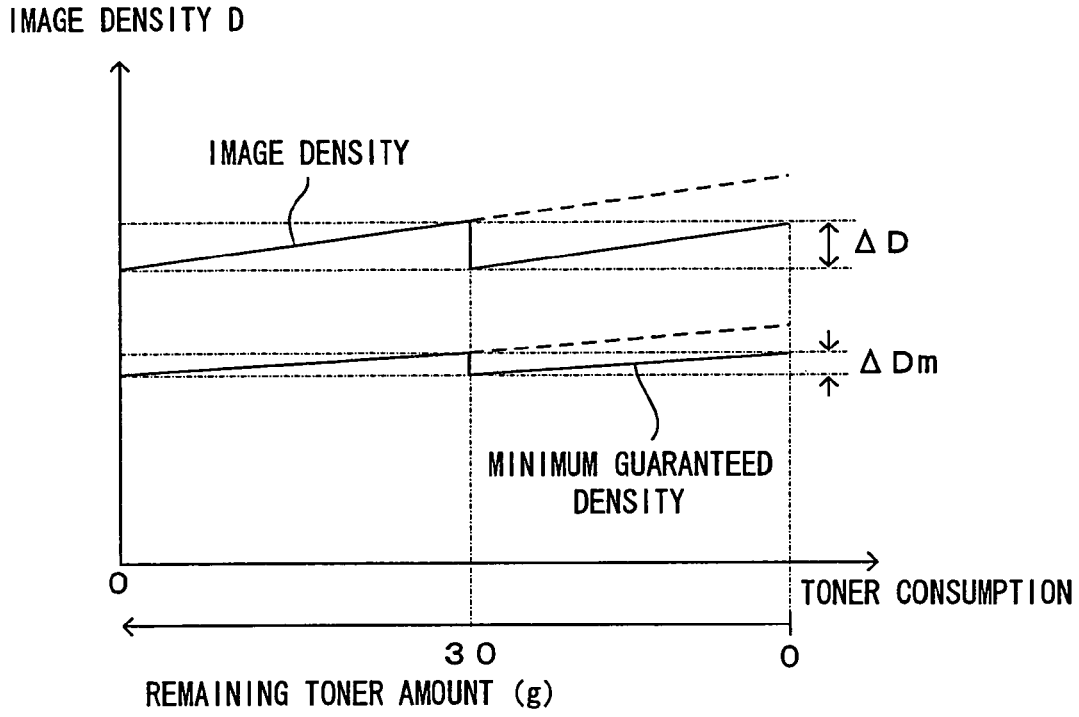
FIG. 22 is a drawing which shows a change of an image density upon application of the numerical values shown in FIG. 21.

FIG. 22 is a drawing which shows a change of an image density upon application of the numerical values shown in FIG. 21. As the control target value is varied over the two levels depending upon the remaining toner amount, the density variation ΔD of an image is suppressed to a relatively small value since the initial stage where the remaining toner amount is large until the later stage where the toner runs short. In contrast, when the control target value is set constant, as denoted at the broken line in FIG. 22, the image density D gradually departs away from the initial value as the remaining toner amount becomes smaller, which manifests itself as an increasing density variation.

Further, as the error threshold value is varied over the two levels depending upon the remaining toner amount, a variation ΔDm of the minimum guaranteed density is also suppressed to a small value.

As described above, in this embodiment, the image forming conditions are controlled based on the result of toner amount detection on a toner which is formed as a patch image, and whether the apparatus is an abnormal state is determined. At this stage, the toner amount control target Ttgt for control of the image forming conditions is varied in accordance with the state of use of toner within the developer, namely, the remaining toner amount within the developer, and hence, it is possible to maintain an image density stable regardless of whether the characteristic of toner within the developer has changed.

In addition, the appropriate range of the toner amount constituting a patch image is varied depending upon the state of use of toner within the developer, and whether the apparatus is an abnormal state is determined based on whether the detected toner amount of an actually formed patch image is within the appropriate range. This guarantees a constant image density regardless of whether the characteristic of toner within the developer has changed, and allows proper recognition of abnormality in the event that an image density is outside the appropriate range.

As described above, in this embodiment, the intermediate transfer belt 71 functions as an "image carrier" of the present invention, while the exposure unit 6, the developer unit 4 and the photosensitive cartridge 2 working as one unit function as "image forming device" of the present invention. Meanwhile, the CPU 101 and the sensor 60 function as "controller" and "toner amount detector" of the present invention, respectively. Further, the memories 91 through 94 disposed to the developers 4Y, 4C, 4M and 4K function as "memory" of the present invention.

The present invention is not limited to the preferred embodiments above, but may be modified in various manners in addition to the preferred embodiments above, to the extent not deviating from the object of the invention. For instance, although the second embodiment described above requires that the number of print dots formed is counted for calculation of the remaining toner amount, other means which calculates the amount of toner within the developer may calculate the remaining toner amount.

Further, while the error threshold value and the control target value are varied depending upon the remaining toner amount within the developer in the second embodiment above, since the characteristic of toner within the developer could change due not only to the remaining toner amount but also to the degree of fatigue-induced deterioration, the degree of toner deterioration may also be considered during the process of determining the error threshold value and the control target value. The degree of toner deterioration can be estimated from the duration of use of the developer (or the driving time of the developer roller) for instance.

In addition, the method of determining the error threshold value of the toner amount of a patch image is neither limited to the method described above but may be other method.

Third Embodiment

In a third and a fourth embodiments of the image forming apparatus 1 according to the present invention, the engine controller 10, and more particularly, the CPU 101 executes an adjustment operation of forming a toner image as a patch image and adjusting the developing bias within the apparatus based on the result of density detection on the image at predetermined timing, such as immediately after turning on of the power source of the apparatus and when a predetermined number of images have been just formed, to thereby control the image density to a predetermined target density. An image having a predetermined image quality can therefore be formed in a stable fashion.

Since the image pattern of a patch image is known, the image density of the patch image is predictable to a certain extent. It is considered that the image density of an actually formed patch image will be approximately close to a prediction value as long as the apparatus is working normally. On the other hand, there may be cases that owing to malfunction of the apparatus, a detection result largely deviating from the prediction value will be obtained. In this embodiment, a presumably appropriate range of a patch image density is determined in advance, and depending upon whether the result of actual density detection is within this appropriate range, the content of the subsequent operation becomes different. The specific operation will now be described while taking the third and the fourth embodiments as an example. Although how thick a patch image is will be hereinafter expressed as an image density derived from conversion of an output signal from the sensor 60, since the density of a patch image reflects the amount of toner constituting the patch image, use of the toner amount constituting the patch image as the scale to measure how thick the patch image is would be the same in principle.

Figure 23:
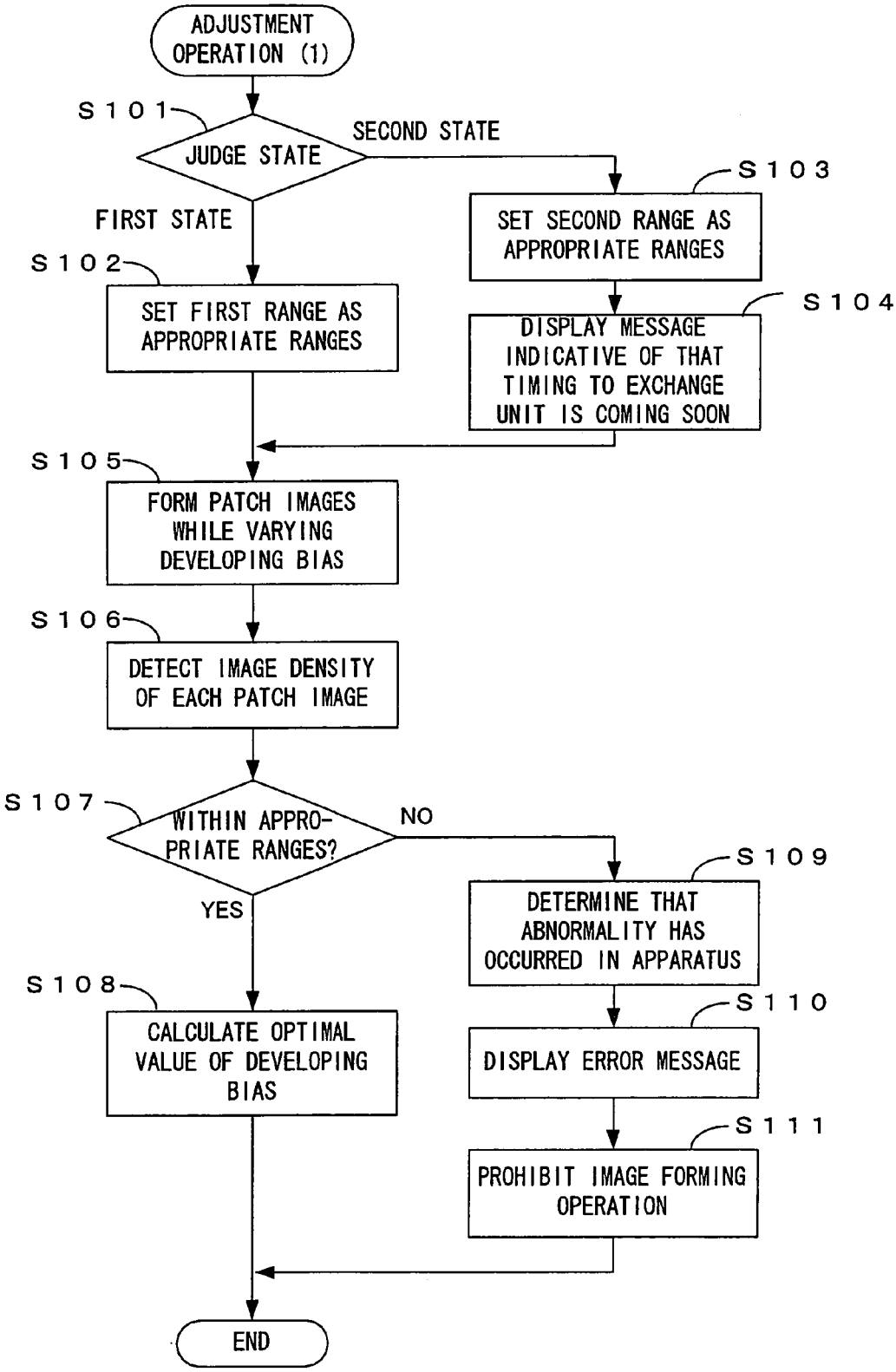
FIG. 23 is a flow chart of the adjustment operation in the third embodiment.

FIG. 23 is a flow chart of the adjustment operation in the third embodiment. During the adjustment operation, first, in which state the engine part EG is currently is judged (Step S101).

In the event that the predetermined capabilities of the respective components forming the engine part EG are maintained and a sufficient amount of toner is held within each developer, it is judged that the engine part EG is in a first state. Under the first state, unless something abnormal suddenly occurs, it is possible to form an image whose quality meets the specifications of the apparatus.

On the contrary, when the capability of one of the respective components forming the engine part EG has deteriorated or toner is left only in a small amount within one of the developers, it is possible that an image whose quality meets the specifications of the apparatus will not be formed. It is judged that the engine part EG is in a second state, in such a case. A deterioration of the components' capabilities and a decrease of the remaining toner amount occur over time, and the image quality accordingly deteriorates over time. Hence, the engine part EG being in the second state does not readily mean that the image quality of an image is always poor. However, while the first state guarantees a certain image quality, the second state does not.

As indicator information which indicates the state of the engine part EG, the remaining toner amount (or the toner consumption) within each developer, the operation amount (the driving time or the number of revolutions) of the photosensitive member 22, the operation amount (the driving time or the number of revolutions) of a developer roller 44 or the like can be used. As described below, these values affect the quality of images which are formed. The state of the engine part EG can be judged based on any one of such indicator information or a proper combination of the indicators.

When toner within the developer starts running short, the developer roller 44 fails to receive enough toner and the density of an image becomes insufficient. The consumed amount of toner or the amount of toner remaining within the developer can be identified by directly measuring the toner amount within the developer, for instance. It is also possible to estimate the toner consumption for each color, based on a toner count calculated from an image signal supplied from an external apparatus.

Further, even when there still is toner remaining within the developer, the characteristic of the toner may have already deteriorated. The degree of such deterioration also affects the quality of images. For example, in the case of toner which has repeatedly adhered to and departed from the developer roller 44 within the developer, since the charging capability of the toner becomes low, the efficiency of development drops. The degree of toner deterioration can be estimated not only from the remaining toner amount but also from the total driving time or number of revolutions of the developer roller 44.

Meanwhile, as used longer and longer, the photosensitive member 22 gets worn out and becomes thinner, and the capability of the photosensitive member 22 becomes inferior. In general, wear of the photosensitive member 22 makes it impossible to form an electrostatic latent image with a sufficient contrast, and hence, the density of a toner image becomes low. In other words, when the total operation amount of the photosensitive member 22 grows, it may become impossible to obtain a sufficient image quality. How much the photosensitive member 22 has got worn out can be estimated the total rotation time or number of revolutions of the photosensitive member 22.

On the other hand, in an instance that the state is judged using the indicator information regarding the developers or toner, indicator information for each one of the toner colors exists. When indicator information all indicates satisfaction of conditions (hereinafter referred to as "image quality maintaining conditions") which must be met to form an image having a favorable quality, it is judged that the engine part EG is in the first state. In contrast, when the indicator information on at least one toner color denotes dissatisfaction of a certain image quality maintaining condition, it is judged that the engine part EG is in the second state. This is because the image quality of a color image can not be maintained when there is even only one toner color for which a sufficient image quality can not be expected.

However, the black color (K) which is the color for monochrome images may be treated in a particular manner. That is, a monochrome image needs no consideration of a balance with the other colors and is mainly the image of a letter or line which, relatively speaking, does not demand tone reproducibility, a density variation to a certain extent may be tolerated. When the indicator information regarding the black color alone has failed to satisfy the quality maintaining conditions and the indicator information regarding all of the other toner colors satisfy the quality maintaining conditions, it may be judged that the engine part EG is in the first state.

Since the capability of the photosensitive member 22 obviously influences all toner colors, it is not proper to handle the indicator information regarding the photosensitive member 22 in such a manner. In short, it is desirable to determine that the engine part EG is in the first state when the indicator information regarding the photosensitive member 22 satisfies the quality maintaining conditions and that the engine part EG is in the second state when the indicator information regarding the photosensitive member 22 does not satisfy the quality maintaining conditions.

An example of the quality maintaining conditions is as follows (where the number of pages is a count converted into sheets of the A4 size in accordance with the Japanese Industrial Standards):

As for the operation amount of the photosensitive member 22, 16,000 pages or fewer;

As for a toner consumption, a toner count of twelve million or less; and

As for the operation amount of the developer roller 44, 6,000 pages or fewer.

Further, since the sensor 60 detects the density of a patch image transferred onto the intermediate transfer belt 71 in this image forming apparatus, the density could change while a toner image visualized on the photosensitive member 22 gets transferred onto the intermediate transfer belt 71. Such a change is dependent upon the degree of wear of the intermediate transfer belt 71, and therefore, the quality maintaining conditions may be set also as for the operation amount of the transfer unit 7.

With the quality maintaining conditions set like this, it is judged that the engine part EG is in the first state when the engine part EG is new and the remaining toner amount is sufficient. Each operation-related information is updated as the engine part EG is used more and more, and at a certain point, the engine part EG shifts to the second state. The engine part EG being in the second state means that the timing to exchange any unit of the photosensitive member 22 and the developers 4Y, 4C, 4M and 4K is coming soon.

At the time of judging the state of the engine part EG, the result of the past judgment may be referred to. In other words, once the engine part EG has shifted to the second state, the engine part EG will not return to the first state unless toner is supplied again or the worn unit is exchanged. Hence, when the engine part EG has been found in the second state through the previous adjustment operation and there is no fact that necessary unit exchange has taken place, the CPU 101 can determine the engine part EG is still in the second state, without referring to the respective operation-related information.

When an image formation request is received from a user or an external apparatus while the engine part EG is in the second state, if the user keeps forming an image, the user may not be able to obtain a desired image quality in some cases. Hence, it is generally prohibited to form an image in such a situation. However, this leads to the following problems. That is, shifting of the engine part EG into the second state does not immediately degrade the image quality. To prohibit formation of an image despite this is not an effective use of the apparatus. In addition, since a unit for replacement may not always be readily available to the user, the user can not use the apparatus until a new unit has been procured. Further, it is not possible to meet the demand of some users who, for a cost advantage, wish to use this unit to the very end of its life while fully aware of a risk of some deterioration of the image quality.

This embodiment solves these problems by means of the adjustment operation executed in the following manner. That is, after judging the state the engine part EG as described above, an appropriate range of a patch image density is determined in accordance with the result of the judgment (Step S102, Step S103). As described later, during the adjustment operation in this embodiment, patch images are formed while varying the developing bias Vdev over multiple levels. A typically appropriate range is then defined for each one of a patch image formed at the minimum developing bias Vmin and a patch image formed at the maximum developing bias Vmax, and whether abnormality has occurred in the apparatus is determined by comparing the actually detected density with the appropriate ranges.

Figure 24A:
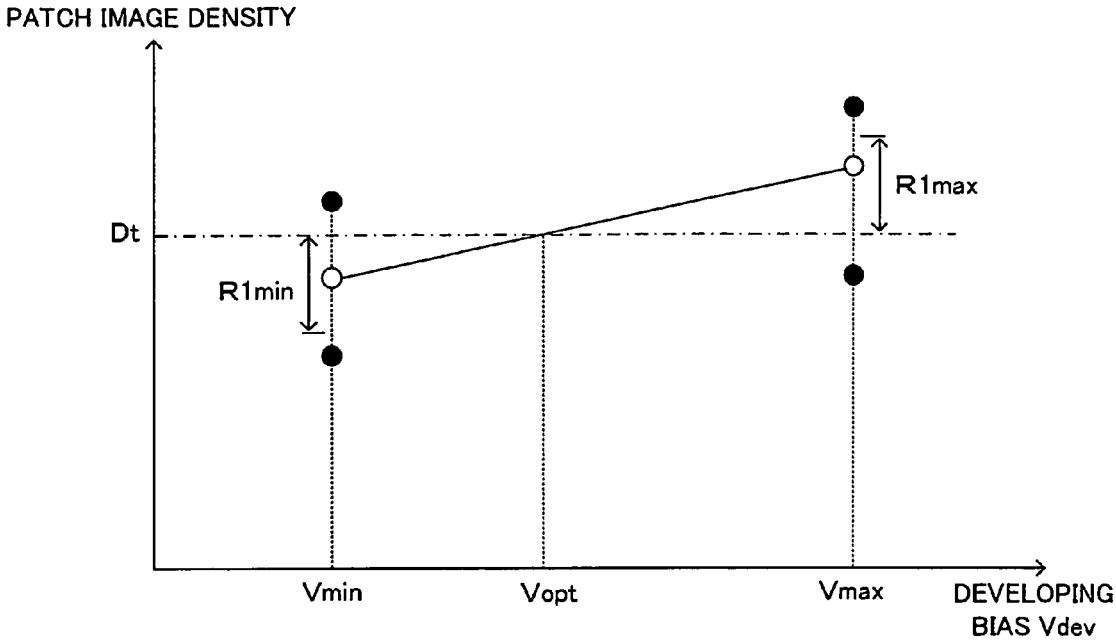
FIGS. 24A and 24B are drawings which show an example of settings of the appropriate ranges of a patch image density in the third embodiment.
Figure 24B:
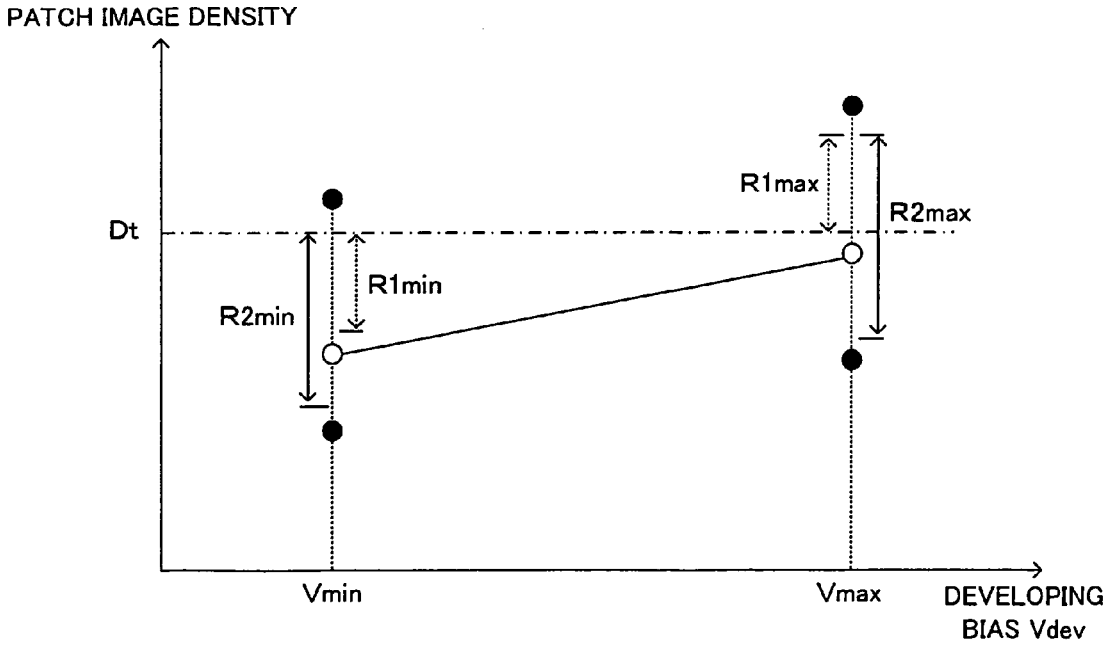

FIGS. 24A and 24B are drawings which show an example of settings of the appropriate ranges of a patch image density in this embodiment. First, a situation that the engine part EG is in the first state will now be described with reference to FIG. 24A. In this case, appropriate ranges R1min and R1max are determined for each one of a patch image formed at the developing bias Vmin which is assumed to attain the lowest patch image density and a patch image formed at the developing bias Vmax which is assumed to attain the highest patch image density. These appropriate ranges correspond to ranges of a density variation which is likely to occur when an image is formed using the engine part EG which is in the first state. In FIG. 23, the appropriate ranges R1min and R1max are collectively referred to as a "first range."

The upper limit value in the appropriate range R1min is preferably a target density Dt of a patch image, and the lower limit value in the appropriate range R1max is preferably the target density Dt. This promises the following effect. As long as the results of density detection on patch images formed at the developing biases Vmin and Vmax are respectively within the appropriate ranges R1min and R1max, as denoted at the white circles and the solid line connecting the white circles in FIG. 24A, the optimal value Vopt of the developing bias at which the patch image density coincides with the target density Dt is always between Vmin and Vmax. Hence, in this case, this image forming apparatus achieves a desired image density when the developing bias Vdev is set at the optimal value Vopt.

In contrast, as denoted at the black circles in FIG. 24A, the patch image density could be outside the appropriate ranges. In the first state, each indicator information denotes that the apparatus must be in such a state which permits formation of an image having an excellent image quality. If the patch image density is outside the appropriate ranges despite this, it is considered that something abnormal happened in the apparatus. Abnormality in the apparatus can thus be detected by judging whether the results of density detection on patch images are within the appropriate ranges.

Next, a situation that the engine part EG is in the second state will now be described with reference to FIG. 24B. In this condition, even though the apparatus itself is free of malfunction, a density variation of a patch image is greater than in the first state. Noting this, appropriate ranges R2min and R2max wider than the appropriate ranges in the first state and corresponding to the developing biases Vmin and Vmax are determined. Since the image density often decreases in the second state, the appropriate ranges are preferably expanded toward the lower-density side. In FIG. 23, the appropriate ranges R2min and R2max are collectively referred to as a "second range."

The adjustment operation will be described continuously, referring back to FIG. 23. As described above, during the adjustment operation, the state of the engine part EG is judged and the appropriate ranges of a patch image density are determined based on the result of this (Step S101 through Step S103). When the engine part EG is in the second state, since the timing to exchange one of the units is coming soon, the display 12 shows a message indicative of this (Step S104). In this manner, a user can prepare a new unit before it becomes impossible to form an image. While the description below is on an operation for one toner color, the following operation is executed for each one of the toner colors in reality.

Next, while varying the developing bias Vdev over multiple levels within the developing bias variable range (Vmin through Vmax), patch images having a predetermined pattern are formed at the respective bias values (Step S105). Following this, the sensor 60 detects the image densities of these images (Step S106). As for those among the patch images which have been formed at the minimum and the maximum developing biases Vmin and Vmax, whether the detected densities are within the appropriate ranges which have been determined in advance is judged (Step S107).

At this stage, if the detected densities of these two patch images are within the appropriate ranges, it can be determined that the apparatus is working normally. Noting this, based on the detected densities of the respective patch images, the optimal value or the second most preferable value of the developing bias Vdev is calculated (Step S108). When the engine part EG is in the first state, there should be the bias value Vopt at which the image density coincides with the target density Dt within the variable range of the developing bias Vdev, and hence, this value may be used as the optimal value of the developing bias Vdev.

On the other hand, when the engine part EG is in the second state, a bias value at which the image density coincides with the target density Dt may not always exist. While such a value if any can be used as the optimal value of course, in the event that there is not such a value, a bias value at which the image density is the closest to the target density may be used as the second most preferable value. In the example shown in FIG. 24B, using the developing bias Vdev as the maximum value Vmax within the developing bias variable range, an image density closest to the target density can be obtained.

When the image forming operation is executed with the developing bias Vdev set to thus calculated optimal value or second most preferable value, the following effects are achieved. First, when the engine part EG is in the first state, it is possible to form an image whose image density is the desired density Dt in a stable manner. Since the image densities in the respective colors are each appropriately controlled, a color image having a favorable image quality is formed stably without destroying the balance between the toner colors. Meanwhile, since the image forming operation can be performed also when the engine part EG is in the second state and since the developing bias Vdev is adjusted so as to come as close as possible to the optimal state, it is possible to suppress deterioration of the image quality.

On the other hand, when at least one of the detected densities of the two patch images is outside the appropriate ranges, the CPU 101 executes the following error processing. That is, the CPU 101 decides that something abnormal has occurred in the apparatus (Step S109), makes the display 12 show a message indicative of that there is abnormality (Step S110), and prohibits the engine part EG from executing the image forming operation (Step S111). This obviates that an image will be formed even though the apparatus is in the abnormal state. In addition, a user can learn about the abnormality and takes necessary countermeasures.

Abnormality referred to here is abnormality arising during density detection, in addition to such abnormality which arises from abnormality with the engine part EG and which makes the density of an image deviate largely from the desired density. For instance, a relatively minor defect such as contamination on the sensor 60 or the intermediate transfer belt 71 and a contact failure of an interconnection line may in some cases give rise to a wrong detection result while an actual patch image has a correct density. Against this background, as a message encouraging a user to clean the apparatus, the adjustment operation may be executed once again after the cleaning has finished. Since it is considered that something severely abnormal has happened in the apparatus if this still does not solve the abnormality, a message recommending inspection performed by a service person may be displayed.

As described above, in this embodiment, the appropriate ranges of a patch image density for judging whether there is abnormality with the apparatus are made different in accordance with the state of the engine part EG. To be more specific, when the engine part EG is in the first state which permits to form an image having a desired image quality, relatively narrow ranges are set as the appropriate ranges. On the contrary, when the engine part EG is in the second state which could deteriorate the image quality, wider ranges than these are set as the appropriate ranges. In the event that the detected densities of patch images are outside the appropriate ranges, the image forming operation is prohibited, judging that something abnormal has happened in the apparatus. This promises the following effects.

It is possible to form an image whose image density is favorable in a stable manner when the engine part EG is in the first state. Even in the presence of minor abnormality, it is possible to securely detect abnormality which would manifest itself as a change in patch image density. Hence, there is no problem that an image having a deteriorated quality is formed in vain due to abnormality within the apparatus. The maintainability is also excellent since a user can learn about the abnormality at an early stage and exercise appropriate measures to solve the abnormality.

Meanwhile, when the engine part EG is in the second state, although the image quality could possibly deteriorate, it is possible for a user to keep forming an image as the user wishes, which is convenient to the user. Expansion of the appropriate ranges toward the lower-density side (the lower-toner amount side) in particular would tolerate a decreasing density attributed to a natural deterioration of the capability of the apparatus, thereby satisfying a user's demand to use the photosensitive member 22 and the developers 4Y, etc., to the very end of their lives. Since a deviation of a patch image density from the appropriate ranges is determined as abnormality even in this case, it is possible to properly handle the abnormality.

Further, a message indicating that the engine part EG is in the second state appears on the display 12 when the engine part EG is in the second state, and therefore, even when an image formed in this condition shows a deterioration in quality, a user can see that the deterioration is due to a natural deterioration occurring in the apparatus. If the quality of the image is satisfactory to the user, the user can keep using the apparatus as is, whereas when the user is unhappy with the image quality, the user may simply do necessary maintenance work (e.g., exchanging of the unit) in response to the message.

Fourth Embodiment

Figure 25:
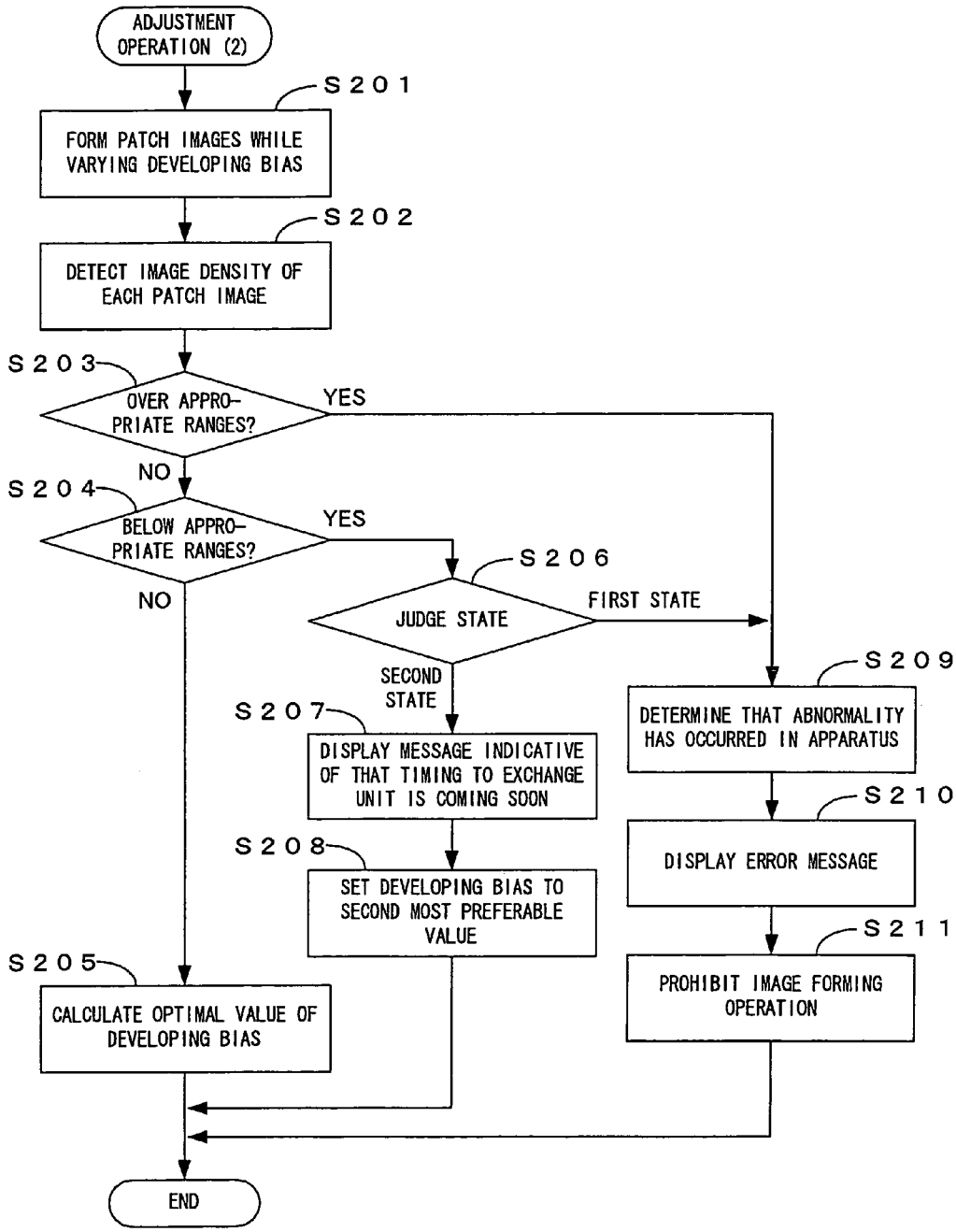
FIG. 25 is a flow chart of the adjustment operation in the fourth embodiment of the present invention.

FIG. 25 is a flow chart of the adjustment operation in the fourth embodiment of the present invention. During the adjustment operation in the fourth embodiment, the appropriate ranges are fixed to which the results of density detection on patch images are referred. In other words, the same appropriate ranges are used regardless of whether the engine part EG is in the first state or the second state. However, the content of processing after it has been found that a patch image is outside the appropriate ranges changes depending upon the state of the engine part EG.

In this embodiment, first, patch images are formed (Step S201). The method used here is similar to the one used in the third embodiment, i.e., while varying the developing bias Vdev over multiple levels within the developing bias variable range (Vmin through Vmax), patch images are formed at the respective bias values. This embodiment is the same as the third embodiment also in that the image densities of these patch images are then detected (Step S202). Following this, among these patch images, as for the two patch images which have been formed at the minimum developing bias Vmin and the maximum developing bias Vmax, the detected densities are compared with the appropriate ranges which have been determined in advance.

Figure 26:
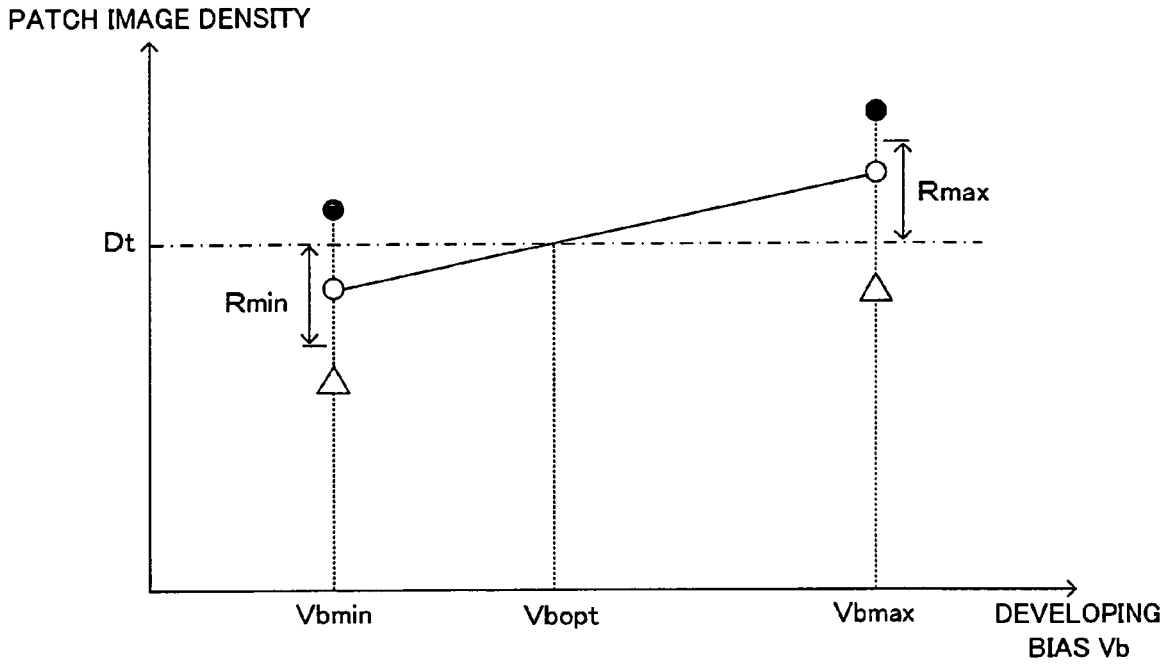
FIG. 26 is a drawing of an example of settings of the appropriate ranges of a patch image density in the fourth embodiment.

FIG. 26 is a drawing of an example of settings of the appropriate ranges of a patch image density in this embodiment. In this embodiment, the appropriate ranges are the appropriate range Rmin with which the image density of a patch image formed at the minimum developing bias Vmin is compared and the appropriate range Rmax with which the image density of a patch image formed at the maximum developing bias Vmax is compared. These appropriate ranges are determined uniformly independently of the state of the engine part EG. Further, each one of the appropriate ranges may be determined based on a similar philosophy to that applied in the third embodiment to the appropriate ranges which are used for a situation that the engine part EG is in the first state.

The adjustment operation will be described continuously, referring back to FIG. 25. At Step S203, whether the detected densities of the two patch images are over the appropriate ranges is determined. When at least one of the detected densities of the two patch images is outside the appropriate ranges toward the higher-density side as denoted at the black circles in FIG. 26, this deviation can not be a natural change occurring in the apparatus but instead could be abnormality in the apparatus such as more than necessary amount of adhering toner and an abnormal output signal from the sensor 60. Therefore, error processing is executed in such a case at Step S209 through Step S211. The content of this error processing is the same as that of the error processing performed in the third embodiment (Step S109 through Step S111 in FIG. 23).

When the above is not the case, Step S204 is executed to determine whether each density detection result is below the lower limit value of the corresponding the appropriate range. When the judgment results are all NO, that is, when the detected densities are equal to or larger than the lower limit values, the density detection results are within the appropriate ranges as denoted at the white circles in FIG. 26. In this case, since there should always be such an optimal value Vopt at which a patch image density can be controlled to the target density Dt within the variable range of the developing bias Vdev, as in the third embodiment, processing for calculating this optimal value is performed (Step S205).

On the contrary, the results at Step S204 are YES, that is, when either one of the detected densities is below the lower limit value of the corresponding appropriate range as denoted at the white triangles in FIG. 26, the state of the engine part EG is judged (Step S206) and different operations are then carried out depending upon the result of the judgment. The state can be judged in a similar fashion to that in the third embodiment.

When it is found that the engine part EG is in the first state, the density shortage is very likely because of abnormality in the apparatus. In this case therefore the apparatus proceeds to Step S209 and the error processing is executed. When the engine part EG is in the second state, it is difficult to determine whether the cause of the density shortage is abnormality in the apparatus or an insufficient amount of remaining toner or a natural deterioration occurring in the apparatus. In this case therefore, instead of determining that there is abnormality in the apparatus, the apparatus stays ready for formation of images. That is, from the detected densities of the patch images, the optimal value of the developing bias Vdev for achieving the target density Dt or the second most preferable value of the developing bias Vdev for obtaining an image density which is as close as possible to the target density Dt is calculated (Step S208), whereby the apparatus remains ready to perform the image forming operation at thus calculated bias value so that a deterioration of the image quality will be suppressed. In this case as well, as in the third embodiment, the display 12 shows a message which tells a user that the engine part EG is in the second state (Step S207).

FIG. 27 is a drawing of a result of the adjustment operation in this embodiment. In FIG. 27, "EXCESSIVE DENSITY" and "INSUFFICIENT DENSITY" appearing in DENSITY DETECTION RESULT express that "at least one of the detected densities of the two patch images is outside the appropriate ranges toward the higher-density side" and that "at least one of the detected densities of the two patch images is outside the appropriate ranges toward the lower-density side," respectively. Meanwhile "OPTIMAL CONDITION" denotes a state that the developing bias Vdev is set to the optimal value Vopt for all of the toner colors. Further, "QUASI-OPTIMAL CONDITION" denotes a state that the developing bias Vdev is set to the second most preferable value for at least one of the toner colors but to the optimal value Vopt for the other toner colors, including a state that the developing bias Vdev is set to the second most preferable value for all toner colors.

As shown in FIG. 27, the result of the adjustment operation turns out to be as follows. In the event that the detected densities are within the appropriate ranges, there is no abnormality in the apparatus and it is possible to form an image under the optimal image forming condition. This permits to form an image whose image quality is excellent in a stable manner. When at least one of the two patch images has an excessive density, image formation is prohibited. Meanwhile, in the event that the patch images have insufficient densities, image formation is prohibited when the engine part EG is in the first state at that time, whereas when the engine part EG is in the second state, image formation is possible.

As described above, in this embodiment, the appropriate ranges are determined in advance to which the densities of patch images are compared to determine that the apparatus is normal. When the detected densities are within the appropriate ranges, determining that the apparatus is working normally, the optimal value Vopt of the developing bias Vdev is calculated based on the detected densities. As the image forming operation is performed with the developing bias Vdev set to the optimal value Vopt, this image forming apparatus stably forms an image having a desired image density. This remains the same regardless of whether the engine part EG is in the first state or the second state.

On the contrary, in the event that the detected densities are outside the appropriate ranges, the following processing executed as abnormality handling processing. When the engine part EG is in the first state, since the deviation of the detected densities from the appropriate ranges is considered to be attributable to abnormality in the apparatus, the error processing is carried out. Execution of the image forming operation in this abnormal condition will be thus avoided, thereby preventing formation of an image having an inferior quality. In addition, the error message indicative of the abnormality appears, which encourages a user to take necessary measures.

Meanwhile, when the engine part EG is in the second state, it is foreseeable in advance that an insufficient image density could happen due to toner shortage, a deterioration in the apparatus, etc. In short, in this condition, a deviation of the detected densities of patch images from the appropriate ranges toward the lower-density side is "an expected result" in a way. Since the apparatus is kept ready for the image forming operation in this case, the apparatus is convenient to those users who can not prepare the replacement unit in time or wish to use the photosensitive member 22 and the developers 4Y, etc., to the very end of their lives. On the other hand, a deviation of the detected densities toward the higher-density side is considered to indicate that "unexpected abnormality" has occurred in the apparatus. In this case therefore, the error processing is executed to prohibit the image forming operation.

In the third embodiment described above, although the lower limit values of the appropriate ranges of a patch image density are lowered depending upon the state of the engine part EG to thereby expand the appropriate ranges while the higher limit values are not changed, this is not limiting. The higher limit values, too, may be changed.

Further, although the higher limit values or the lower limit values of the appropriate ranges are coincided with the target density Dt in the third and the fourth embodiments described above, this is not always necessary. In short, the appropriate ranges may simply be ranges covering such toner image densities (or the amount of toner constituting a toner image) from which it is decided that the apparatus is working normally at the applied developing bias value.

Further, since the third and the fourth embodiments above are directed to such an apparatus which controls an image density through adjustment of the developing bias Vdev, patch images are formed at different developing bias values. The appropriate ranges are determined respectively for patch images formed at the two types of bias values, i.e., the minimum developing bias Vmin and the maximum developing bias Vmax. However, the number of thus formed patch images and for how many of these patch images the appropriate density ranges are to be determined may be freely decided. In addition, the developing bias Vdev may not always be variable. Rather, other operation parameter may be variable.

Further, although the higher limit values and the lower limit values of the appropriate ranges of a patch image density are both determined in the third and the fourth embodiments described above, only one of these may be set. For instance, the appropriate ranges may be determined such that a patch image formed at the minimum developing bias Vmin should have the target density Dt or a lower density and a patch image formed at the maximum developing bias Vmax should have the target density Dt or a higher density. This is allowable since in this manner as well, as long as the densities of the two patch images are within the appropriate ranges, the variable range of the developing bias (Vmin through Vmax) must contain such an optimal value Vopt at which the image density can be controlled to the target density Dt.

In the fourth embodiment described above, patch images having insufficient densities are not treated as an indicator of abnormality in the apparatus, when the engine part EG is in the second state. However, an extremely low density may be treated as an indicator of abnormality. In addition, while the state of the engine part EG is judged only when the densities of patch images are insufficient in this embodiment, judging the state prior to comparison of the patch image densities with the appropriate ranges would lead to the same result.

Further, when the engine part EG is in the second state, the apparatus is kept ready for the image forming operation while the display 12 shows a message indicating that the timing to exchange one of the units is coming soon, in the third and the fourth embodiments described above. Instead of this, the following may be exercised. That is, a message is displayed which tells that there is a possibility the image quality will deteriorate, and if a user still wishes to form an image with the knowledge of the possibility, the user is allowed a particular operation. Only a certain number of images will be formed only after the user has implemented the particular operation. In this manner, image formation using the engine part EG which is in the second state can take place only when a user particularly wishes for the image formation, and an image whose quality fails to meet the user's demand will not be formed in vain. The allowable number of images at this stage may be a particular number such as 1 and 10, or alternatively, the count designated for this job may be used instead.

As described above, in the respective embodiments above, the engine part EG functions as "image forming device" of the present invention. Meanwhile, the engine controller 10, and particularly the CPU 101, functions as "state judging device" and "controller" of the present invention. The sensor 60, the photosensitive member 22 and the developer roller 44 function respectively as "toner amount detector," a "latent image carrier" and a "toner carrier" of the present invention. The display 12 functions as "informing device" of the present invention. Further, in the second embodiment described above, the processing (Step S206 through Step S211) executed when patch image densities are outside the appropriate ranges corresponds to "abnormality handling operation" of the present invention.

While the embodiments above are each an application of the present invention to an apparatus which forms an image using toner in the four colors of yellow, magenta, cyan and black, the types and the number of the toner colors are not limited to the above but can be freely determined. In addition, the present invention is applicable not only to an apparatus of the rotary development type but also to an image forming apparatus of the so-called tandem type in which the developers for the respective toner colors are arranged side by side in one line along the direction of sheet transportation. Further, the present invention is not limited to an apparatus of the electrophotographic type as in the embodiments above but is applicable generally to any image forming apparatus which uses toner.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A toner consumption calculating apparatus which calculates for each color a toner consumption demanded by image formation on a recording medium using a developer unit which comprises toner cartridges which are respectively filled with toner of a plurality of colors, comprising:

a toner counter which counts a toner consumption during the image formation;

a sensor which detects the density of a patch image;

a calculator which calculates a cumulative count of the toner consumption;

a judging device which judges whether the cumulative count of the toner consumption is equal to or smaller than a first predetermined value, and judges whether a result of the detection performed by the sensor is equal to or smaller than a second predetermined value; and a controller which corrects the cumulative count of the toner consumption when the judging device judges that the cumulative count of the toner consumption and the result of the detection are respectively equal to or smaller than the first predetermined value and the second predetermined value.

2. The toner consumption calculating apparatus of claim 1, wherein the second predetermined value is a threshold value of a patch image density which is set in accordance with a remaining toner amount.

3. The toner consumption calculating apparatus of claim 1, wherein the result of the detection performed by the sensor corresponds to a last one of patch images which are formed over a predetermined times while increasing a developing bias.

4. The toner consumption calculating apparatus of claim 1, wherein the result of the detection performed by the sensor corresponds to a density difference between a first one and a last one of patch images which are formed over a predetermined times while increasing a developing bias.

5. The toner consumption calculating apparatus of claim 1, wherein the first predetermined value is a numerical value representing half amount between an initial value and a numerical value which demands displaying of a message encouraging to exchange a toner cartridge.

6. The toner consumption calculating apparatus of claim 1, wherein the cumulative count of the toner consumption which is corrected by the controller corresponds to a numerical value which demands displaying of a message encouraging to exchange a toner cartridge.

7. An image forming apparatus comprising;

a toner consumption calculating apparatus of claim 1;

a memory which stores remaining toner amounts in the respective colors within the toner cartridges; and an exchange judging device which judges, upon arrival of the remaining toner amount in each color at a predetermined value, that it is time to exchange an associated toner cartridge, wherein the remaining toner amounts are calculated by subtracting toner consumption amounts from initial values and lives of the toner cartridges are managed.

8. The image forming apparatus of claim 7, wherein the predetermined value is either one of a near-end value, an end value and an end-end value which correspond to progressively smaller remaining toner amounts in this order.

9. The image forming apparatus of claim 7, wherein the predetermined value is set different values depending upon an image occupancy rate which is a ratio of an area of image to an area of a recording medium.

10. The image forming apparatus of claim 7, wherein as the toner cartridges, a plurality of toner cartridges which are cartridges having a large capacity and cartridges having a small capacity are capable by exchanging with each other, and the predetermined value is set to different values for the same color between the plurality of toner cartridges.

11. An image forming apparatus comprising;

a toner consumption calculating apparatus of claim 1; and a latent image carrier which is structured so as to be capable of carrying an electrostatic latent image, wherein the developer unit rotates in a predetermined rotation direction while carrying on its surface the toner held within the plurality of toner cartridges, thereby sequentially transporting the toner in different colors to opposed positions facing the latent image carrier, and a developing bias is applied between the latent image carrier and the developer unit, the toner is moved from the developer unit to the latent image carrier, the electrostatic latent image is visualized, and a toner image is formed.

12. The image forming apparatus of claim 11, wherein the toner image formed on the image carrier is transferred onto an intermediate transfer member.

13. A toner consumption calculating method of calculating for each color a toner consumption demanded by image formation on a recording medium using a developer unit which comprises toner cartridges which are respectively filled with toner of a plurality of colors, comprising the steps of:

a step of counting the number of pixels at which toner is consumed;

a step at which a sensor detects the density of a patch image;

a step of calculating a cumulative count of the toner consumption;

a judging step of judging whether the cumulative count of the toner consumption is equal to or smaller than a first predetermined value and whether the a result of the detection performed by the sensor is equal to or smaller than a second predetermined value; and a correcting step at which the cumulative count is corrected when it is judged that the cumulative count of the toner consumption and the result of the detection are respectively equal to or smaller than the first predetermined value and the second predetermined value.

14. The toner consumption calculating method of claim 13, wherein at the judging step, whether the cumulative count of the toner consumption is equal to or smaller than the first predetermined value is judged first, and whether the result of the detection performed by the sensor is equal to or smaller than the second predetermined value is judged next.

15. The toner consumption calculating method of claim 13, wherein at the judging stage, whether the result of the detection performed by the sensor is equal to or smaller than the second predetermined value is judged first, and the cumulative count of the toner consumption is equal to or smaller than the first predetermined value is judged next.

16. An image forming apparatus, comprising:

an image forming device which internally comprises a developer which holds toner, forms a toner image using the toner and makes an image carrier carry the toner image;

a toner amount detector which detects the amount of the toner constituting the toner image carried on the image carrier; and a controller which controls an image forming condition for the image forming device, based on a result of the detection performed by the toner amount detector on the toner image serving as a patch image, wherein the controller sets an appropriate range regarding the amount of the toner constituting the patch image, depending upon a state of the toner held within the developer, and judges that abnormality has occurred in the apparatus when the result of the detection performed by the toner amount detector on the patch image is not within the appropriate range.

17. The image forming apparatus of claim 16, wherein the controller sets the appropriate range in accordance with a remaining toner amount within the developer.

18. The image forming apparatus of claim 17, wherein the controller shifts a lower limit value of the appropriate range toward a lower-toner amount side, as the remaining toner amount decreases.

19. The image forming apparatus of claim 16, wherein the developer is freely attachable to and detachable from a main section of the apparatus, and a memory which stores information regarding use of the toner held within the developer is attached to the developer.

20. The image forming apparatus of claim 16, wherein the controller controls the image forming condition based on the result of the detection performed by the toner amount detector on the patch image and based on a predetermined control target value, and the control target value is set depending upon the state of the toner held within the developer.

21. A control method for an image forming apparatus in which a toner image is formed using toner held within a developer and then made carried by an image carrier, a toner amount of the toner constituting the toner image carried as a patch image on the image carrier is detected, and an image forming condition is controlled based on a result of the detection, comprising the steps of:

a step of setting an appropriate range regarding the amount of the toner constituting the patch image depending upon the state of use of the toner, and a step of judging that abnormality has occurred in the apparatus when the result of the detection found on the toner amount of the patch image is not within the appropriate range.

22. An image forming apparatus, comprising:

an image forming device which executes an image forming operation and forms a toner image;

a state judging device which judges whether the state of the image forming device is a first state that the image quality of the toner image is good or a second state that the image quality of the toner image could become inferior to that in the first state, based on indicator information which is indicative of the history of use of the image forming device;

a toner amount detector which detects a toner amount constituting the toner image formed as a patch image by the image forming device; and a controller which sets an appropriate range regarding the amount of the toner constituting the patch image in accordance with the result of the judgment made by the state judging device, and determines that abnormality has occurred in the apparatus when the result of the detection performed by the toner amount detecting means is not within the appropriate range.

23. The image forming apparatus of claim 22, wherein the controller sets the appropriate range such that when the result of the judgment made by the state judging device is the second state, the appropriate range is wider than that for where the result of the judgment is the first state.

24. The image forming apparatus of claim 22, wherein the controller sets the appropriate range such that when the result of the judgment made by the state judging device is the second state, a lower limit value of the appropriate range is closer toward the lower-toner amount side than where the result of the judgment is the first state.

25. The image forming apparatus of claim 22, further comprising an informing device which informs a user of the state of the apparatus when the result of the judgment made by the state judging device is the second state and/or when the controller determines that abnormality has occurred in the apparatus.

26. The image forming apparatus of claim 22, wherein the image forming device comprises a latent image carrier which is capable of carrying an electrostatic latent image, and the state judging device uses the operation amount of the latent image carrier as the indicator information.

27. The image forming apparatus of claim 22, wherein the image forming device is structured so as to be capable of holding toner, and the state judging device uses a remaining toner amount within the image forming means as the indicator information.

28. The image forming apparatus of claim 27, wherein the image forming device is structured so as to be capable of forming a color image which uses a plurality of toner colors, and the state judging device judges that the apparatus is in a first state when the indicator information related to each one of the plurality of toner colors each satisfies a predetermined image quality maintaining condition, but judges that the apparatus is in a second state when at least one of the indicator information fails to satisfy the image quality maintaining condition.

29. The image forming apparatus of claim 22, wherein the image forming device comprises a toner carrier which carries toner, and the state judging device uses the operation amount of the toner carrier as the indicator information.

30. The image forming apparatus of claim 29, wherein the image forming device is structured so as to be capable of forming a color image which uses a plurality of toner colors, and the state judging device judges that the apparatus is in a first state when the indicator information related to each one of the plurality of toner colors each satisfies a predetermined image quality maintaining condition, but judges that the apparatus is in a second state when at least one of the indicator information fails to satisfy the image quality maintaining condition.

31. An image forming apparatus, comprising:

an image forming device which executes an image forming operation and forms a toner image;

a state judging device which judges whether the state of the image forming means is a first state that the image quality of the toner image is good or a second state that the image quality of the toner image could become inferior to that in the first state, based on indicator information which is indicative of the history of use of the image forming device;

a toner amount detector which detects a toner amount constituting the toner image formed as a patch image by the image forming device; and a controller which executes abnormality handling operation when the result of the detection performed by the toner amount detector on the patch image is not within a predetermined appropriate range, wherein the controller changes the content of the abnormality handling operation in accordance with the result of the judgment made by the state judging device.

32. The image forming apparatus of claim 31, wherein during the abnormality handling operation under a condition that the result of the judgment made by the state judging device is the first state, the controller prohibits execution of the image forming operation by the image forming device, and during the abnormality handling operation under a condition that the result of the judgment made by the state judging device is the second state, the controller permits execution of the image forming operation by the image forming device.

33. The image forming apparatus of claim 32, wherein during the abnormality handling processing under a condition that the result of the judgment made by the state judging device is the second state, when the result of the detection performed by the toner amount detector is outside the appropriate range toward the higher-density side, the controller prohibits execution of the image forming operation by the image forming device, whereas when the result of the detection performed by the toner amount detector is outside the appropriate range toward the lower-density side, the controller permits execution of the image forming operation by the image forming device.

34. The image forming apparatus of claim 31, further comprising an informing means which informs a user of the state of the apparatus when needed, upon execution of the abnormality handling processing.

35. The image forming apparatus of claim 31, wherein the image forming device comprises a latent image carrier which is capable of carrying an electrostatic latent image, and the state judging device uses the operation amount of the latent image carrier as the indicator information.

36. The image forming apparatus of claim 31, wherein the image forming device is structured so as to be capable of holding toner, and the state judging device uses a remaining toner amount within the image forming means as the indicator information.

37. The image forming apparatus of claim 36, wherein the image forming device is structured so as to be capable of forming a color image which uses a plurality of toner colors, and the state judging device judges that the apparatus is in a first state when the indicator information related to each one of the plurality of toner colors each satisfies a predetermined image quality maintaining condition, but judges that the apparatus is in a second state when at least one of the indicator information fails to satisfy the image quality maintaining condition.

38. The image forming apparatus of claim 31, wherein the image forming device comprises a toner carrier which carries toner, and the state judging device uses the operation amount of the toner carrier as the indicator information.

39. The image forming apparatus of claim 38, wherein the image forming device is structured so as to be capable of forming a color image which uses a plurality of toner colors, and the state judging device judges that the apparatus is in a first state when the indicator information related to each one of the plurality of toner colors each satisfies a predetermined image quality maintaining condition, but judges that the apparatus is in a second state when at least one of the indicator information fails to satisfy the image quality maintaining condition.

40. A control method for an image forming apparatus, comprising:

a state judging step of judging whether the state of image forming device, which executes an image forming operation and forms a toner image, is a first state that the image quality of the toner image is good or a second state that the image quality of the toner image could become inferior to that in the first state, based on indicator information which is indicative of the history of use of the image forming device;

a setting step of setting an appropriate range regarding the amount of the toner constituting the patch image which serves as a patch image, in accordance with the result of the judgment at the state judging step;

a patch image forming step at which the image forming device forms the patch image; and an abnormality judging step of detecting the toner amount of the patch image, and when the result of the detection is not within the appropriate range, judging that abnormality has occurred in the apparatus.

41. A control method for an image forming apparatus, comprising:

a state judging step of judging whether the state of image forming device, which executes an image forming operation and forms a toner image, is a first state that the image quality of the toner image is good or a second state that the image quality of the toner image could become inferior to that in the first state, based on indicator information which is indicative of the history of use of the image forming means;

a patch image forming step at which the image forming device forms the toner image as a patch image;

a detection step of detecting the toner amount of the patch image; and an abnormality handling step which is executed when the result of the detection at the detection step is not within the appropriate range, wherein the content of the abnormality, handling operation is changed in accordance with the result of the judgment at the state judging step.

* * * * *